US006169366B1

(12) United States Patent
Niimi

(10) Patent No.: US 6,169,366 B1
(45) Date of Patent: Jan. 2, 2001

(54) HIGH PRESSURE DISCHARGE LAMP

(75) Inventor: Norikazu Niimi, Kasugai (JP)

(73) Assignee: NGK Insulators, Ltd., Nagoya (JP)

( * ) Notice: Under 35 U.S.C. 154(b), the term of this patent shall be extended for 0 days.

(21) Appl. No.: 08/998,311

(22) Filed: Dec. 24, 1997

(51) Int. Cl.[7] ..... H01J 17/04; H01J 61/04

(52) U.S. Cl. ..... 313/633; 313/623; 313/625; 313/572

(58) Field of Search ..... 313/633, 623, 313/635, 636, 631, 632, 311, 630, 625, 572

(56) References Cited

U.S. PATENT DOCUMENTS 5,861,714 * 1/1999 Wei et al. ..... 313/625

FOREIGN PATENT DOCUMENTS 0 160 445 11/1985 (EP) .
0 271 877 6/1988 (EP) .
0 341 750 11/1989 (EP) .
0 609 477 8/1994 (EP) .
0 751 549 1/1997 (EP) .
0 807 957 11/1997 (EP) .
2-132750 5/1990 (JP) .
7-211292 8/1995 (JP) .
8-273616 10/1996 (JP) .

* cited by examiner

*Primary Examiner*—Nimeshkumar D. Patel
*Assistant Examiner*—Joseph Williams
(74) *Attorney, Agent, or Firm*—Burr & Brown

(57) ABSTRACT

A vessel has a main body and a plugging members made of alumina. First composite electrode has a cylindrical current conductor having substantially same diameter as a diameter of the opening portion at one end of the vessel, and an electrode jointed by welded at a bottom of the current conductor exposed to inside of the vessel. The current conductor of the first composite electrodes has a cylindrical member made of alumina and a metallization layer made of molybdenum and alumina. A ceramic discharge tube is made in that the vessel and a first composite electrode have been subjected to a co-firing into an integrated body, with the first composite electrode inserted into the opening portion at one end of the vessel so that the electrode is exposed to the inner space with one end of the first composite electrode is exposed to outside of the vessel.

21 Claims, 19 Drawing Sheets

HIGH PRESSURE DISCHARGE LAMP

FIELD OF THE INVENTION

The present invention relates to a high pressure discharge lamp, such as a high pressure sodium light-emitting lamp, a metal halide lamp, and to a method of manufacturing such a high pressure discharge lamp. The present invention also relates to a composite electrode for a high pressure discharge lamp, and a method of manufacturing such a composite electrode.

BACKGROUND ART

Conventionally, such a high pressure discharge lamp comprises a vessel made of a non-conductive material (e.g. alumina) which forms an inner space filled with an ionizable light-emitting material and a starting gas, and which has opening portions at the ends thereof. The high pressure discharge lamp also comprises a composite electrode having a substantially cylindrical current conductor made of a conductive material (e.g. molybdenum) with a diameter which is substantially same as that of the opening portion at one end of the vessel, and an electrode electrically connected to the current conductor. In this instance, a gap between the current conductor and the vessel is tightly sealed.

In this type of high pressure discharge lamp, there is a significant difference between the coefficient of thermal expansion of the conductive material forming the current conductor and that of the non-conductive material forming the vessel (for example, the coefficient of thermal expansion of alumina is $8\times10^{-6}$ $K^{-1}$, and that of molybdenum is $6\times10^{-6}$ $K^{-1}$). Owing to such a difference, when the high pressure discharge lamp is heated such as when the high pressure discharge lamp is in operation, there may be formed a gap between the current conductor on one hand and the vessel and/or the plug on the other hand. In this instance, as the molecular movement of the ionizable light-emitting material and the starting gas in the vessel becomes more active, these ionizable light-emitting material and starting gas may leak through the gap to outside of the vessel.

To avoid such a drawback, JP-A-2-132750 discloses a high pressure discharge lamp wherein, instead of forming the current conductor with only conductive material, the current conductor comprises a substantially cylindrical non-conductive material (e.g. alumina), which is same as that forming the vessel and coated by tungsten with a substantially uniform thickness over the surface of the non-conductive material. In this case, the composite electrode is composed such that a concave portion is provided at the bottom of the current conductor and an electrode is buried in the concave portion, or the electrode is connected to the current conductor with another member such as a cap. Also, the vessel and the composite electrode have been subjected to a co-firing into an integrated body, with the current conductor inserted into the opening portion at one end of the vessel so that the electrode is exposed to the inner space with one end of the composite electrode exposed to outside of the vessel. In this way, by composing most of the current conductor of a non-conductive material which is the same as the that forming the vessel, the adverse influence of the difference in the coefficient of thermal expansion between the conductive material (in this case, tungsten) and the non-conductive material is made substantially insignificant.

Also, JP-A-7-211292 discloses a high pressure discharge lamp wherein the current conductor comprises a substantially cylindrical non-conductive material, which is the same as that forming the vessel, and covered by a layer of mixture of platinum and alumina, a layer of platinum, and a layer of a mixture of platinum and alumina, with a substantially uniform thickness and one above the other over the surface of the non-conductive material. In this case, also, the composite electrode is composed such that a concave portion is provided at the bottom of this current conductor and an electrode is buried in the concave portion, or the electrode is connected to the current conductor with another member such as a cap. Therefore, the adverse influence of the difference in the coefficient of thermal expansion between the conductive material and the non-conductive material is made substantially insignificant.

Also, JP-A-8-273616 discloses a high pressure discharge lamp wherein the current conductor is formed with the substantially cylindrical non-conductive material, which is the same as that forming the vessel material, and covered by a halide-resistant metal such as niobium, tungsten, etc., with a substantially uniform thickness over the surface of the non-conductive material. In this case, the composite electrode is also composed such that a concave portion is provided at the bottom of this current conductor and an electrode is buried in the concave portion, or the electrode is connected to the current conductor with another member such as a cap. Therefore, the adverse influence of the difference in the coefficient of thermal expansion between the conductive material and the non-conductive material is made substantially insignificant. However, in the high pressure discharge lamp disclosed in JP-A-2-132750, the composite electrode having the current conductor metallized with tungsten, whose melting point (3400° C.) is higher than that of alumina (2015° C.), is co-fired with the vessel into an integrated body. In this case, the melting point of tungsten in metallization is much different from that of alumina in metallization, so that the firing speed of tungsten is different from that of alumina. Also, the mutual wetting property of tungsten and aluminum is poor, and it is thus difficult to form a tightly metallized layer. Therefore, such a high pressure discharge lamp is not fully gas-tight.

Further, in the high pressure discharge lamps disclosed in JP-A-7-211292 and JP-A-8-273616, the vessel and the composite electrode are not co-fired into an integrated body at least at one end of the vessel. Thus, a stronger junction cannot be formed between the non-conductive material of the vessel and metallized layer on the composite electrode, as compared to an arrangement wherein the vessel and the composite electrode are co-fired into an integrated body. Therefore, such a high pressure discharge lamp is not fully gas-tight, either.

Moreover, in the composite electrodes for the high pressure discharge lamps disclosed in JP-A-2-132750, JP-A-7-211292 and JP-A-8-273616, it is preferred that the composite electrode can be easily manufactured and have a uniform thickness of the metallized layer over the surface of the current conductor.

In the conventional high pressure discharge lamp, when the gap between the current conductor and the vessel is tightly sealed, a frit seal is used. In this case, the proximity of the opening portion at one end of the vessel is heated to a predetermined temperature (e.g. 1500° C.). On such occasion, the other end of the vessel is cooled in order to prevent the molecular movement of the ionizable light-emitting material and starting gas from being active such that they are prevented from leaking through the frit seal of the vessel to outside of the vessel. However, in spite of such cooling, the inner part of the vessel is still heated to a substantial temperature (e.g. 300–400° C.) even for a limited period (e.g. 1–3 minutes). Thus, there still remains the possibility for the ionizable light-emitting material and starting gas to more or less leak through the frit seal of the vessel to outside of the vessel.

SUMMARY OF THE INVENTION

It is a first object of the present invention to provide a high pressure discharge lamp having a satisfactory gas-tight property while fully maintaining the required conductivity, as well as a method of manufacturing the same.

It is a second object of the present invention to provide the high pressure discharge lamp capable of preventing the ionizable light-emitting material and starting gas filled in the inner portion of the vessel from leaking to outside of the vessel at the time of tightly sealing, as well as a method of manufacturing the same.

It is a third object of the present invention to provide the composite electrode for a high pressure discharge lamp which is easy to manufacture and realize a uniform thickness of the metabolized layer over the surface of the current conductor, as well as a method of manufacturing the same.

The high pressure discharge lamp according to the invention comprises a vessel made of a non-conductive material which forms an inner space filled with an ionizable light-emitting material and a starting gas, and has opening portions at both ends thereof; and a composite electrode having a substantially cylindrical current conductor with a diameter which is substantially the same as a diameter of the opening portion at one end of the vessel, and an electrode electrically connected to the current conductor; the current conductor of the composite electrode being formed by a substantially cylindrical member coated with a mixture of a metal and a non-conductive material; the metal of the mixture coated on said substantially cylindrical member containing not less than 50 vol. % of molybdenum, and the non-conductive material of the mixture containing not less than 50 vol. % of a material which is the same as that forming the vessel; the vessel and the composite electrode having been subjected to a co-firing into an integrated body, with the composite electrode inserted into the opening portion at one end of the vessel so that the electrode is exposed to the inner space with one end of the composite electrode exposed to outside of the vessel. According to the invention, the current conductor is formed by a substantially cylindrical member coated with a mixture of a metal and a non-conductive material, and the composite electrode comprising such a current conductor and the vessel have been subjected to a co-firing into an integrated body. By having been subjected to a co-firing into an integrated body in such a manner, the non-conductive material in the vessel and the substantially cylindrical member is diffused into the layer of the mixture formed on a surface of the substantially cylindrical member so that a strong joining structure is formed between the vessel and the substantially cylindrical member.

Here, in order to form such a strong joining structure, it is necessary for the metal of the mixture coated on the substantially cylindrical member to contain a metal which has melting point comparatively close to those of the nearly cylindrical member and the vessel, and has enough halide resistance, and for its non-conductive material to contain a material which is the same as that forming the vessel and the substantially cylindrical member. To fulfill such requirements, according to the high pressure discharge lamp of the invention, the metal of the mixture coated on the substantially cylindrical member contains not less than 50 vol. % of molybdenum which has halide resistance and a lower melting point (2623° C.) than that of tungsten, and the non-conductive material of the mixture coated on the substantially cylindrical member contains not less than 50 vol. % of a material which is the same as that forming the vessel.

Therefore, with the current conductor being formed by the substantially cylindrical member coated with the mixture of a metal and a non-conductive material, and the vessel and the composite electrode having been subjected to a co-firing into an integrated body to form a strong joining structure between the vessel and the substantially cylindrical member, the high pressure discharge lamp according to the invention has the fully gas tight property while maintaining full conductivity. Further, a substantially cylindrical member is understood to mean not only a cylindrical member itself but also a member in which a concave portion is provided at the bottom of the cylindrical member.

Preferably, the content of the metal of the mixture coated on the substantially cylindrical member is 30 to 70 vol. %.

As the content of the metal of the mixture coated on the substantially cylindrical member becomes high, the conductivity of the high pressure discharge lamp improves. On the other hand, as the content of the non-conductive material of the mixture becomes high, the gas tight property improves. As the result of various experiments by the inventor, in order to keep fully the gas tight property while maintaining fully conductivity, it is found that preferable content of the metal of the mixture is 30 to 70 vol. %.

More preferably, said metal of the mixture coated on the substantially cylindrical member is made of molybdenum, the non-conductive material of the mixture is made of a material which is same as that forming the vessel. In order that the vessel and the composite electrode be subjected to a co-firing into an integrated body to form a strong joining structure between the vessel and the nearly cylindrical shaped member of the current conductor, it is preferable that the content of molybdenum in the metal of the mixture coated on the substantially cylindrical member is as high as possible, and the content of the material which is the same as that forming the vessel in the non-conductive material of the mixture is as high as possible. Therefore, it is most suitable for the mixture to be composed of molybdenum and the material which is the same as that forming the vessel.

Further, molybdenum is understood to mean not only pure molybdenum but also that containing a few impurities, and the material which is the same as that forming the vessel is understood to mean not only completely the same as that forming the vessel but also that containing a few impurities.

Another high pressure discharge lamp according to the invention comprises a vessel made of a non-conductive material which forms an inner space filled with an ionizable light-emitting material and a starting gas, and has opening portions at both ends thereof; and a composite electrode having a substantially cylindrical current conductor with a diameter which is smaller than a diameter of the opening portion at one end of the vessel, and an electrode electrically connected to the current conductor; the current conductor of the composite electrode being formed by a substantially cylindrical member coated with a mixture of a metal and a non-conductive material; the metal of the mixture coated on the substantially cylindrical member containing not less than 50 vol. % of molybdenum, and the non-conductive material of the mixture containing not less than 50 vol. % of a material which is the same as that forming the vessel; the current conductor and the vessel being so arranged relative to each other as to leave a gap therebetween, with the composite electrode inserted into the opening portion at one end of the vessel so that the electrode is exposed to the inner space with one end of the composite electrode exposed to outside of the vessel, the gap being tightly sealed with a metallic layer or a layer made of a mixture of a metal and a material which is the same as that forming the vessel.

According to another high pressure discharge lamp of the invention, the substantially cylindrical current conductor with a diameter which is smaller than a diameter of the opening portion at one end of the vessel is formed by the substantially cylindrical member coated with mixture of the metal and the non-conductive material, and the current conductor and the vessel are so arranged relative to each other as to leave a gap therebetween, with the composite electrode inserted into the opening portion at one end of the vessel so that the electrode is exposed to the inner space with one end of the composite electrode exposed to outside of the vessel, the gap being tightly sealed with a metallic layer or a layer made of a mixture of a metal and a material which is the same as that forming said vessel. By tight sealing with such a layer in such a manner, only the region of the opening portion of one end of the vessel is heated in a moment. Unlike the prior high pressure discharge lamp in which tight sealing is effected with a frit seal, it is not heated over a certain temperature (e.g. 300–400° C.) for a certain time (e.g. 1–3 minutes) so that the movement of the ionizable light-emitting material and the starting gas does not become active and leak the ionizable light-emitting material and the starting gas to outside of the vessel.

Preferably, the content of the metal of the mixture coated on the substantially cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on the substantially cylindrical member is made of molybdenum, and the non-conductive material of the mixture is made of a material which is same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another high pressure discharge lamp according to the invention comprises a vessel made of a non-conductive material which forms an inner space filled with an ionizable light-emitting material and a starting gas, and has opening portions at both ends thereof; a first composite electrode having a substantially cylindrical current conductor with a diameter which is substantially same as a diameter of the opening portion at one end of the vessel, and an electrode electrically connected to the current conductor; and a second composite electrode having a substantially cylindrical current conductor with a diameter which is smaller than a diameter of the opening portion at the other end of the vessel, and an electrode electrically connected to the current conductor; the first and second current conductor of the composite electrode being formed by a substantially cylindrical member coated with a mixture of a metal and a non-conductive material, respectively; the metal of the mixture coated on the substantially cylindrical member containing not less than 50 vol. % of molybdenum, and the non-conductive material of the mixture containing not less than 50 vol. % of a material which is the same as that forming the vessel; the vessel and the first composite electrode having been subjected to a co-firing into an integrated body, with the first composite electrode inserted into the opening portion at one end of the vessel so that the electrode is exposed to the inner space with one end of the first composite electrode exposed to outside of the vessel; and the current conductor of the second composite electrode and the vessel being so arranged relative to each other as to leave a gap therebetween, with the second composite electrode inserted into the opening portion at the other end of the vessel so that the electrode is exposed to the inner space with one end of the second composite electrode exposed to outside of the vessel, the gap being tightly sealed with a metallic layer or a layer made of a mixture of a metal and a material which is same as that forming the vessel.

According to another high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property while having full conductivity.

In this case, although the gap may be tight sealed with such a layer, it may be tight sealed with the frit seal as usual.

Preferably, the content of the metal of the mixture coated on the substantially cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on the substantially cylindrical member is made of molybdenum, the non-conductive material of the mixture is made of a material which is the same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is substantially the same as a diameter of the opening portion at one end of the vessel, and an electrode joined by welding or metaliding at a bottom of the current conductor exposed to the inside of the vessel; the current conductor of the composite electrode being formed by a cylindrical member coated with a mixture of a metal and a non-conductive material; the metal of the mixture coated on the cylindrical member containing not less than 50 vol. % of molybdenum, and the non-conductive material of the mixture containing not less than 50 vol. % of a material which is the same as that forming the vessel; the vessel and the composite electrode having been subjected to a co-firing into an integrated body, with the composite electrode inserted into the opening portion at one end of the vessel so that the electrode is exposed to the inner space with one end of the composite electrode exposed to outside of the vessel.

According to another high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property while fully conductivity.

In this case, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on said cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on said cylindrical member is made of molybdenum, and the non-conductive material of the mixture is made of a material which is the same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is substantially the same as a diameter of the opening portion at one end of the vessel, and an electrode joined by welding or metaliding at a bottom of the current conductor exposed to the inside of the vessel; the current conductor of the composite electrode being formed by a cylindrical member coated with a mixture of a metal and a non-conductive material; the metal of the mixture coated on the substantially cylindrical member containing not less than 50 vol. % of molybdenum, and the non-conductive material of the mixture containing not less than 50 vol. % of a material which is the same as that forming the vessel; the current conductor and the vessel being so arranged relative to each other as to leave a gap therebetween, with the composite electrode inserted into the opening portion at one end of the vessel so that the electrode is exposed to the inner space with one end of the composite electrode is exposed to outside of the vessel, the gap being tightly sealed with a metallic layer or a layer made of a mixture of a metal and a material which is same as that forming the vessel.

According to another high pressure discharge lamp of the invention, as only the region of the opening portion of one end of the vessel is heated in a moment, the ionizable light-emitting material and the starting gas may not leak to outside of the vessel.

Also, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on the cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on said cylindrical member is made of molybdenum, and the non-conductive material of the mixture is made of a material which is same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another high pressure discharge lamp according to the invention comprises a vessel made of a non-conductive material which forms an inner space filled with an ionizable light-emitting material and a starting gas, and has opening portions at both ends thereof; a first composite electrode having a cylindrical current conductor with a diameter which is substantially the same as a diameter of the opening portion at one end of the vessel, and an electrode joined by welding or metaliding at a bottom of the current conductor exposed to the inside of the vessel; and a second composite electrode having a cylindrical current conductor with a diameter which is smaller than a diameter of the opening portion at the other end of the vessel, and an electrode joined by welding or metaliding at a bottom of the current conductor exposed to the inside of the vessel; the first and second current conductor of the composite electrode being formed by a cylindrical member coated with a mixture of a metal and a non-conductive material, respectively; the metal of the mixture coated on the substantially cylindrical member containing not less than 50 vol. % of molybdenum, and the non-conductive material of the mixture containing not less than 50 vol. % of a material which is the same as that forming the vessel; the vessel and the first composite electrode having been subjected to a co-firing into an integrated body, with the first composite electrode inserted into the opening portion at one end of the vessel so that the electrode is exposed to the inner space with one end of the first composite electrode exposed to outside of the vessel; and the current conductor of the second composite electrode and the vessel being so arranged relative to each other as to leave a gap therebetween, with the second composite electrode inserted into the opening portion at the other end of the vessel so that the electrode is exposed to the inner space with one end of the second composite electrode exposed to outside of the vessel, the gap being tightly sealed with a metallic layer or a layer made of a mixture of a metal and a material which is the same as that forming the vessel. According to another high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property and full conductivity. In this case, although the gap may be tight sealed with such a layer, it may be tight sealed with the frit seal as usual.

Also, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on the cylindrical member is 30 to 70 vol. %. By making the content of the metal of the mixture 30 to 70 vol. %, the compatibility of the conductivity and the gas tight property of the high pressure discharge lamp is possible.

More preferably, the metal of the mixture coated on the cylindrical member is made of molybdenum, the non-conductive material of the mixture is made of a material which is the same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed. The composite electrode for a high pressure discharge lamp according to the invention has a cylindrical current conductor coated with a mixture of a metal and a non-conductive material; and an electrode joined by welding or metaliding at a bottom of the current conductor, the metal of the mixture coated on the cylindrical member containing not less than 50 vol. % of molybdenum, and the non-conductive material of the mixture containing not less than 50 vol. % of a material which is the same as that forming the vessel.

The method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material and an electrode electrically connected to the current conductor; the metal of the mixture coating on the substantial cylindrical member containing not less than 50 vol. % of molybdenum, the non-conductive material of the mixture containing not less than 50 vol. % of a material which is the same as that forming said vessel, and the substantially cylindrical current conductor has substantially the same diameter as a diameter of the opening portion at one end of the vessel; inserting said composite electrode into the opening portion at one end of the vessel such that the electrode is exposed to the inner space and one end of the composite electrode is exposed to outside of the vessel, and co-firing the vessel and the composite electrode into an integrated body.

According to the method of manufacturing a high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property and full conductivity.

In this case, although the gap may be tight sealed with such a layer, it may be tight sealed with the frit seal as usual.

Preferably, the content of the metal of the mixture coated on the substantially cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on the substantially cylindrical member is made of molybdenum, and the non-conductive material of the mixture is made of a material which is same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material and an electrode electrically connected to the current conductor; the metal of the mixture coating on the substantial cylindrical member containing not less than 50 vol. % of molybdenum, the non-conductive material of the mixture containing not less than 50 vol. % of a material which is the same as that forming the vessel, and the substantially cylindrical current conductor has a smaller diameter than a diameter of the opening portion at one end of the vessel; inserting the composite electrode into the opening portion at one end of the vessel such that the electrode is exposed to the inner space and one end of the composite electrode is exposed to outside of the vessel, and the current conductor and the vessel being so arranged relative to each other as to leave a gap therebetween, the gap being tightly sealed with a metallic layer or a layer made of a mixture of a metal and a material which is same as that forming the vessel.

According to another method of manufacturing a high pressure discharge lamp of the invention, as only the region of the opening portion of one end of the vessel is heated in a moment, the ionizable light-emitting material and the starting gas may not leak to outside of the vessel.

Preferably, the content of the metal of the mixture coated on the substantially cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on the substantially cylindrical member is made of molybdenum, and the non-conductive material of the mixture is made of a material which is same as that forming the vessel. By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming first and second composite electrodes which have a current conductor formed by a substantially cylindrical member coated with a mixture of a metal and a non-conductive material and an electrode electrically connected to the current conductor, respectively; the metal of the mixture coating on the substantial cylindrical member containing not less than 50 vol. % of molybdenum, and the non-conductive material of the mixture containing not less than 50 vol. % of a material which is the same as that forming the vessel, the substantially cylindrical current conductor of the first composite electrode has substantially the same diameter as a diameter of the opening portion at one end of the vessel, and the substantially cylindrical current conductor of the second composite electrode has a smaller diameter than a diameter of the opening portion at the other end of the vessel; inserting the first composite electrode into the opening portion at one end of the vessel such that the electrode is exposed to the inner space and one end of the first composite electrode is exposed to outside of the vessel; inserting the second composite electrode into the opening portion at the other end of the vessel such that the electrode is exposed to the inner space and one end of the second composite electrode is exposed to outside of the vessel, and the current conductor and the vessel being so arranged relative to each other as to leave a gap therebetween, the gap being tightly sealed with a metallic layer or a layer made of a mixture of a metal and a material which is same as that forming the vessel.

According to another method of manufacturing a high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property and full conductivity.

Preferably, the content of the metal of the mixture coated on the substantially cylindrical member is 30 to 70 vol. %.

By making the content of the metal of the mixture 30 to 70 vol. %, the compatibility of the conductivity and the gas tight property of the high pressure discharge lamp is possible.

More preferably, the metal of the mixture coated on the substantially cylindrical member is made of molybdenum, and the non-conductive material of the mixture is made of a material which is same as that forming the vessel. By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a cylindrical member coated with a mixture of a metal and a non-conductive material and an electrode joined by welding or metaliding at a bottom of the current conductor exposed to inside of the vessel; the metal of the mixture coating on the cylindrical member containing not less than 50 vol. % of molybdenum, the non-conductive material of the mixture containing not less than 50 vol. % of a material which is the same as that forming the vessel, and the cylindrical current conductor has substantially the same diameter as a diameter of the opening portion at one end of the vessel; inserting the composite electrode into the opening portion at one end of the vessel such that the electrode is exposed to the inner space and one end of the composite electrode is exposed to outside of the vessel, and co-firing the vessel and the composite electrode into an integrated body.

According to another method of manufacturing a high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property and full conductivity.

In this case, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided. Preferably, the content of the metal of the mixture coated on the cylindrical member is 30 to 70 vol. %. By making the content of the metal of the mixture 30 to 70 vol. %, the compatibility of the conductivity and the gas tight property of the high pressure discharge lamp is possible.

More preferably, the metal of the mixture coated on the cylindrical member is made of molybdenum, and the non-conductive material of the mixture is made of a material which is same as that forming the vessel.

By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a cylindrical member coated with a mixture of a metal and a non-conductive material and an electrode joined by welding or metaliding at a bottom of the current conductor exposed to inside of the vessel; said metal of the mixture coating on the cylindrical member containing not less than 50 vol. % of molybdenum, the non-conductive material of the mixture containing not less than 50 vol. % of a material which is the same as that forming the vessel, and the substantially cylindrical current conductor has a smaller diameter than a diameter of the opening portion at one end of the vessel; inserting the composite electrode into the opening portion at one end of the vessel such that the electrode is exposed to the inner space and one end of the composite electrode is exposed to outside of the vessel, and the current conductor and the vessel being so arranged relative to each other as to leave a gap therebetween, the gap being tightly sealed with a metallic layer or a layer made of a mixture of a metal and a material which is same as that forming the vessel.

According to another method of manufacturing a high pressure discharge lamp of the invention, as only the region of the opening portion of one end of the vessel is heated in a moment, the ionizable light-emitting material and the starting gas may not leak to outside of the vessel.

Also, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on the cylindrical member is 30 to 70 vol. %. By making the content of the metal of the mixture 30 to 70 vol. %, the compatibility of the conductivity and the gas tight property of the high pressure discharge lamp is possible.

More preferably, the metal of the mixture coated on the cylindrical member is made of molybdenum, and the non-conductive material of the mixture is made of a material which is same as that forming said vessel. By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming first and second composite electrodes which have a current conductor formed by a cylindrical member coated with a mixture of a metal and a non-conductive material and an electrode joined by welding or metaliding at a bottom of the current conductor exposed to inside the vessel, respectively; the metal of the mixture coating on the cylindrical member containing not less than 50 vol. % of molybdenum, and the non-conductive material of the mixture containing not less than 50 vol. % of a material which is the same as that forming the vessel, the cylindrical current conductor of the first composite electrode has substantially the same diameter as a diameter of the opening portion at one end of the vessel, and the cylindrical current conductor of the second composite electrode has a smaller diameter than a diameter of the opening portion at the other end of the vessel; inserting the first composite electrode into the opening portion at one end of the vessel such that the electrode is exposed to the inner space and one end of the first composite electrode is exposed to outside of the vessel; and inserting the second composite electrode into the opening portion at the other end of the vessel such that the electrode is exposed to the inner space and one end of the second composite electrode is exposed to outside of the vessel, and the current conductor and the vessel being so arranged relative to each other as to leave a gap therebetween, the gap being tightly sealed with a metallic layer or a layer made of a mixture of a metal and a material which is same as that forming the vessel.

According to another high pressure discharge lamp of the invention, with the current conductor of the first composite electrode being formed by a substantially cylindrical member coated with a mixture of a metal and a non-conductive material, and the first composite electrode and the vessel having been subjected to a co-firing into an integrated body, the high pressure discharge lamp according to the invention has the fully gas tight property and full conductivity.

In this case, although the gap may be tight sealed with such a layer, it may be tight sealed with the frit seal as usual.

In this case, instead of tight sealing the gap between the current conductor and the vessel at the other end of the vessel by the layer of the mixture of the metal and the non-conductive material, tight sealing may be effected with a frit seal such as used in usual.

Also, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on the cylindrical member is 30 to 70 vol. %. By making the content of the metal of the mixture 30 to 70 vol. %, the compatibility of the conductivity and the gas tight property of the high pressure discharge lamp is possible.

More preferably, the metal of the mixture coated on the cylindrical member is made of molybdenum, and the non-conductive material of the mixture is made of a material which is the same as that forming the vessel. By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

The method of manufacturing a composite electrode for a high pressure discharge lamp according to the invention comprises the steps of: forming a current conductor made of a cylindrical member coated with a mixture of a metal and a non-conductive material, and an electrode welded or metallized joined at a bottom of the current conductor, the metal of the mixture coating on the cylindrical member containing not less than 50 vol. % of molybdenum, and the non-conductive material of the mixture containing not less than 50 vol. % of a material which is the same as that forming the vessel.

In this case, as the electrode is joined by welding or metaliding at a bottom of the current conductor which is formed by a cylindrical member coated with a mixture of a metal and a non-conductive material, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, the content of the metal of the mixture coated on the substantially cylindrical member is 30 to 70 vol. %. By making the content of the metal of the mixture 30 to 70 vol. %, the compatibility of the conductivity and the gas tight property of the high pressure discharge lamp is possible. More preferably, the metal of the mixture coated on the cylindrical member is made of molybdenum, and the non-conductive material of the mixture is made of a material which is same as that forming the vessel. By making the metal of the mixture molybdenum and making the non-conductive material of the mixture the same as that forming the vessel, a stronger joining structure is formed between the vessel and the substantially cylindrical member when the gap between the composite electrode and the vessel is tightly sealed.

Further, when manufacturing the electrode or firing an arc tube, an external lead, etc (Mo, Ni, etc) is attached to the side of the metallized coating of the composite electrode and the vessel and the composite electrode are co-fired into an integrated body.

DESCRIPTION OF THE PREFERRED EMBODIMENTS

Figure 1:
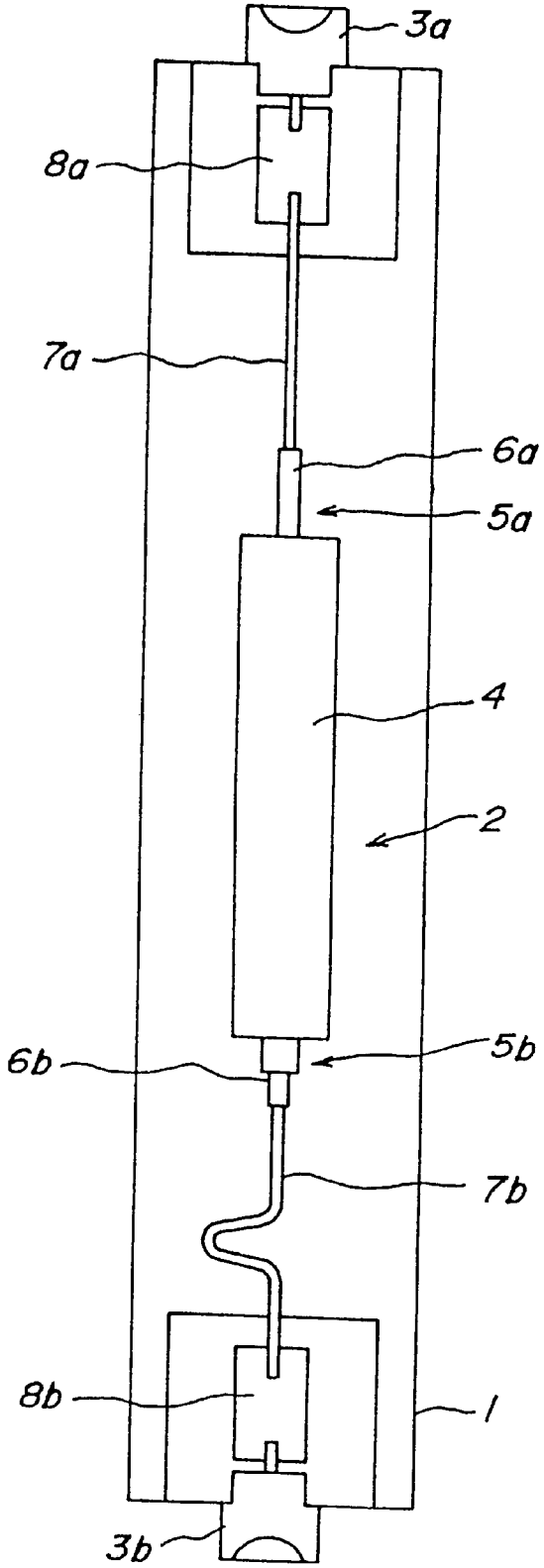
FIG. 1 is a view showing the first embodiment of the invention.

FIG. 1 is a view showing the first embodiment of the invention. A ceramic tube 2 is accommodated within a outer tube 1 made of a quartz glass or a hard glass, and the center axis of the outer tube 1 is aligned with that of the ceramic tube 2.

Both ends of the outer tube 1 are gas-tightly sealed with caps 3*a*, 3*b*, respectively. The ceramic tube 2 comprises a tubular vessel 4 made of a alumina, and first composite electrode 6*a*, 6*b* inserted into opening portions of ends portions 5*a*, 5*b* of the tubular vessel 4, respectively. The ceramic discharge lamp is held by the outer tube 2 via two lead wires 7*a*, 7*b*, and the lead wires 7*a*, 7*b* are connected to the caps 3*a*, 3*b* via foil 8*a*, 8*b*, respectively.

Figure 2:
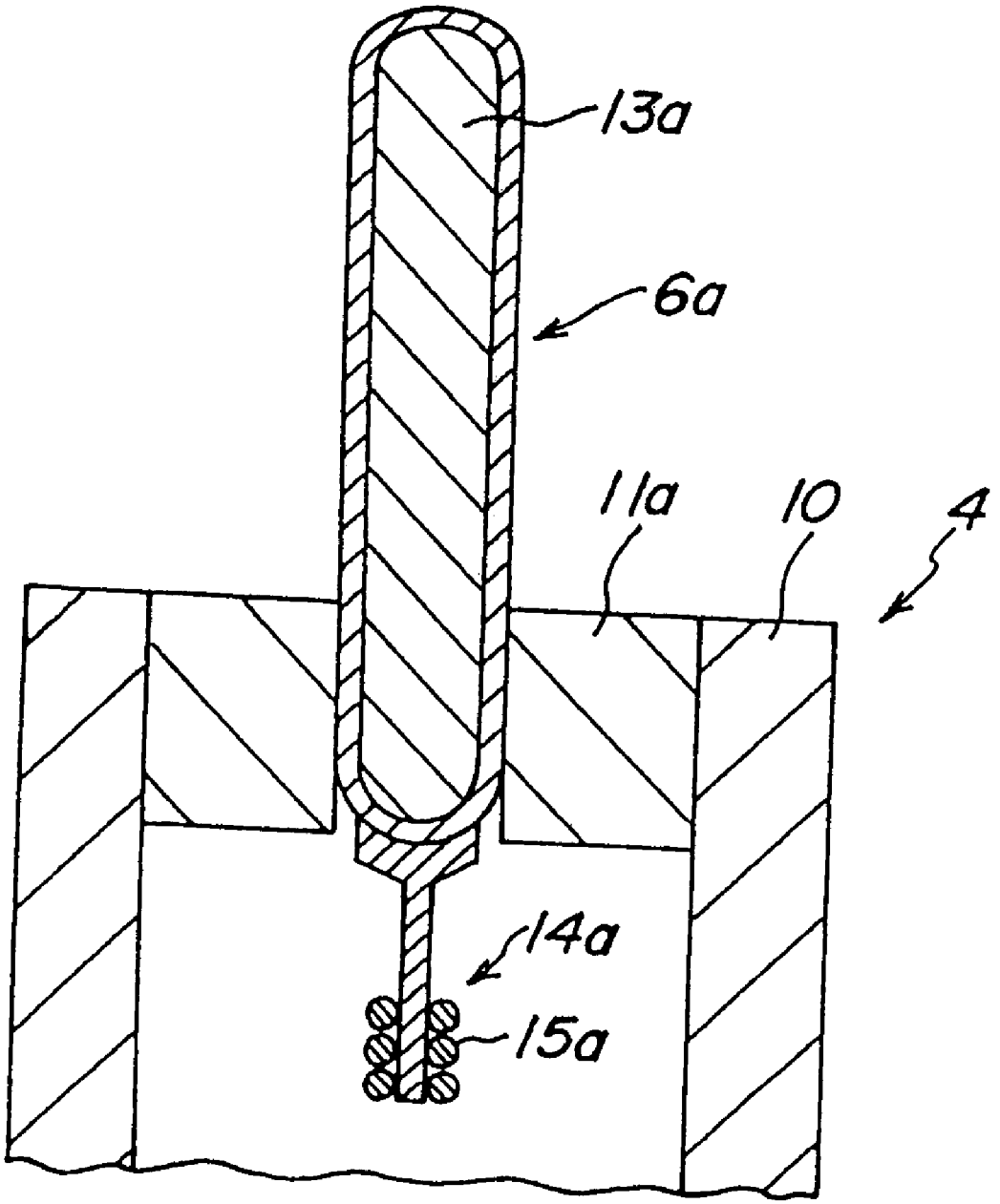
FIG. 2 is a sectional view for showing, in an enlarged scale, the surrounding area around an end portion 5*a* of a ceramic discharge tube 2 of FIG. 1.

FIG. 2A is a top view for showing the end portion 5*a* of the ceramic discharge tube 2 in FIG. 1, and FIG. 2B is a sectional view for showing, in an enlarged scale, the surrounding area around an end portion 5*a* of a ceramic discharge tube 2 in FIG. 1. As shown in FIGS. 2A and 2B, the vessel 4 has a main body 10 and a plugging member made of an alumina. The first composite electrode 6*a* has a cylindrical current conductor 13*a* with a diameter which is substantially the same as a diameter of the opening portion of the plugging member 11*a*, and a electrode 14*a* joined by welding at a bottom of the current conductor 13*a* exposed to inside of the vessel 4. In this case, the electrode 14*a* has a coil 15*a*.

Figure 3:
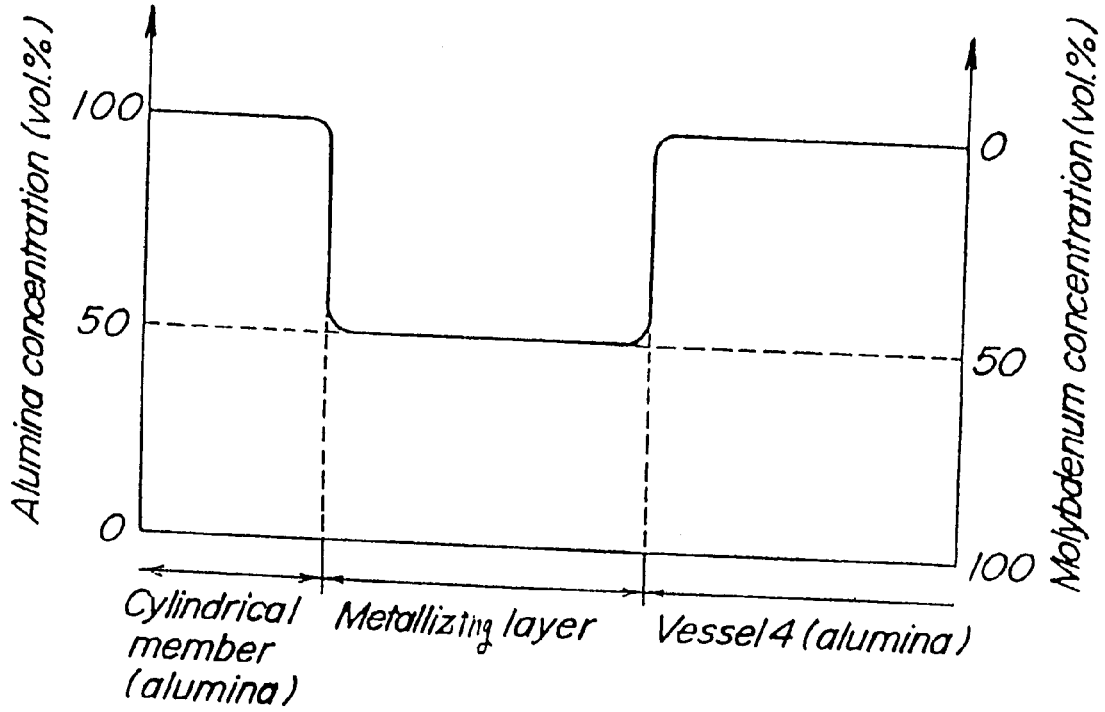
FIG. 3 is a diagram representing the transition of alumina and molybdemun concentrations in the cylindrical shaped member, the metallized layer and the vessel 4.

The first composite electrode 6*a* has a cylindrical member and a metallizing layer composed of a mixture of a molybdenum and a alumina. A diagram representing the transition of alumina and molybdenum concentrations in the cylindrical member, the metallized layer and the vessel 4 is shown in FIG. 3.

The ceramic discharge tube (FIG. 1) is composed such that the vessel 4 and the first composite electrode 6*a* have been subjected to a co-firing into an integrated body, with the first composite electrode 6*a* inserted into the opening portion at one end of the vessel 4 so that the electrode 14 is exposed to the inner space with one end of the first composite electrode 6*a* exposed to outside of the vessel 4.

Figure 4A:
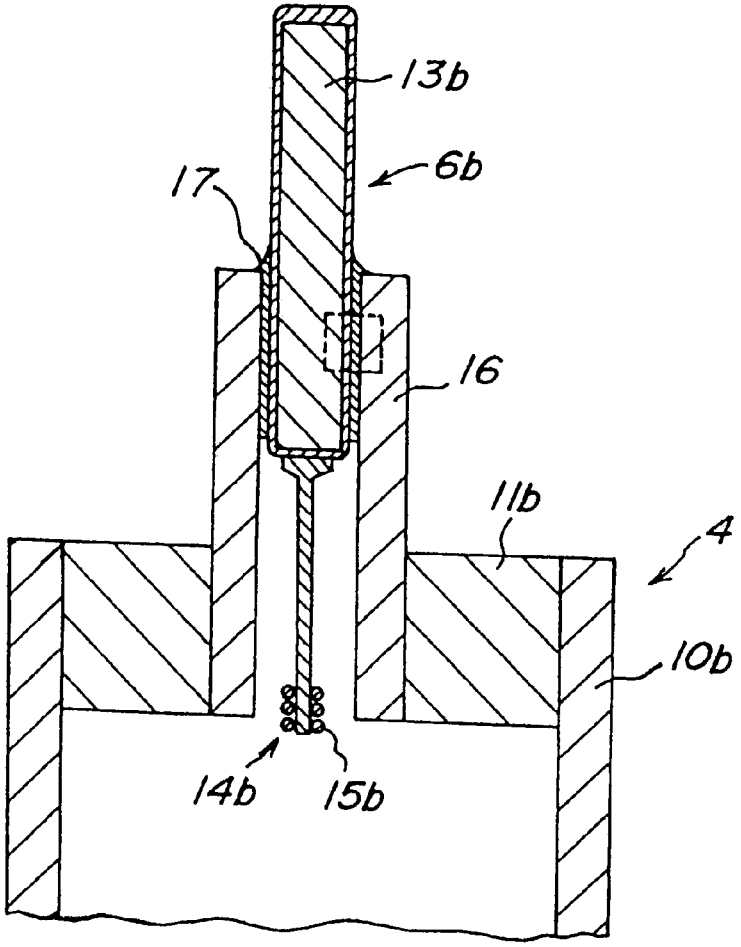
FIG. 4A is a sectional view for showing, in an enlarged scale, the surrounding area around an end portion 5*a* of a ceramic discharge tube 2 of FIG. 1.
Figure 4B:
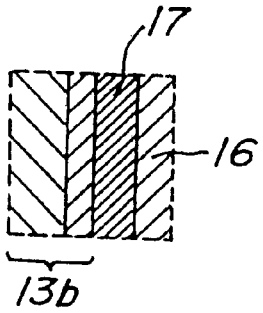
FIG. 4B is a partial enlarged view of the sectional view in FIG. 4A.

FIG. 4B is a sectional view for showing, in an enlarged scale, the surrounding area around an end portion 5*b* of a ceramic discharge tube 2 in FIG. 1, and FIG. 4B is a partial enlarged view of the sectional view in FIG. 4A.

In FIGS. 4A and 4B, the vessel 4 has a plugging member 11*b* made of alumina and a capillary 16. The second composite electrode 6*b* has a cylindrical current conductor 13*b* with a diameter which is smaller than a diameter of the opening portion of the plugging member 11*b*, and a electrode 14*b* joined by welding at a bottom of the current conductor 13*b* exposed to inside of the vessel 4. In this case, also, the electrode 14*b* has a coil 15*b*. Further, a gap between the second composite electrode 6*b* and the capillary 16 is tightly sealed with a frit seal 17.

Figure 5:
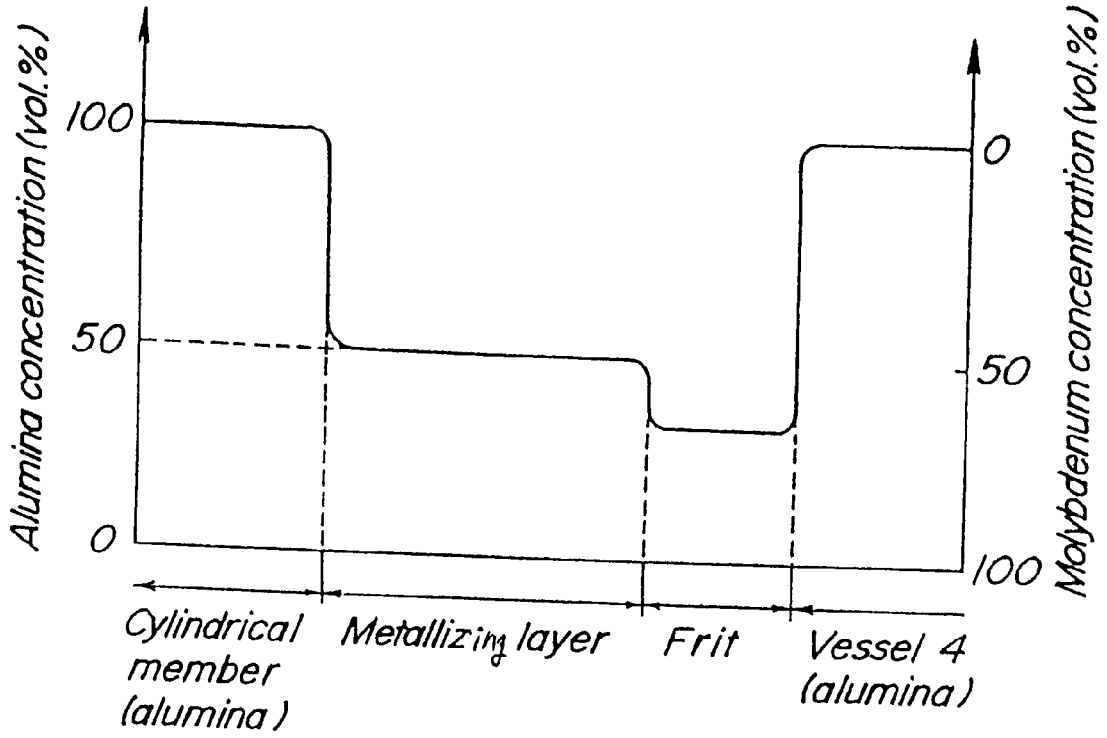
FIG. 5 is a diagram representing the transition of alumina and molybdemun concentrations in the cylindrical shaped member, the metabolized layer and the vessel 4.

The current conductor 13*b* of the second composite electrode 6*b* has a cylindrical member and a metallizing layer composed of a mixture of a molybdenum and alumina. A diagram representing the transition of alumina and molybdenum concentrations in the cylindrical member, the metallized layer and the vessel 4 is shown in FIG. 5.

According to the embodiment of the invention, with the current conductor 13*a* of the first composite electrode 6*a* being formed by a substantially cylindrical member made of a material which is the same as that forming the vessel 4 (alumina) coated with the mixture of the molybdenum and alumina, and the first composite electrode 6*a* and the vessel 4 having been subjected to a co-firing into an integrated body, the high pressure discharge lamp has the fully tight property and full conductivity.

In this case, as the fully gas tight property is held at the end 6*a,* there is no drawback even if a temperature inside of the vessel 4 becomes high when the end portion 6*b* is tightly sealed.

Moreover, as the electrodes 15*a,* 15*b* are joined by welding at the bottom of the current conductors 13*a,* 13*b* which is formed by a cylindrical member coated with the mixture of the molybdenum and alumina, respectively, it is possible to coat the mixture of the metal and alumina over a surface of the current conductor with more uniform thickness than the case where the electrode is buried in a concave portion at the bottom of the current conductor, and it is possible to compose the composite electrode simpler than the case where another member such as a cap is provided.

Figure 6A:
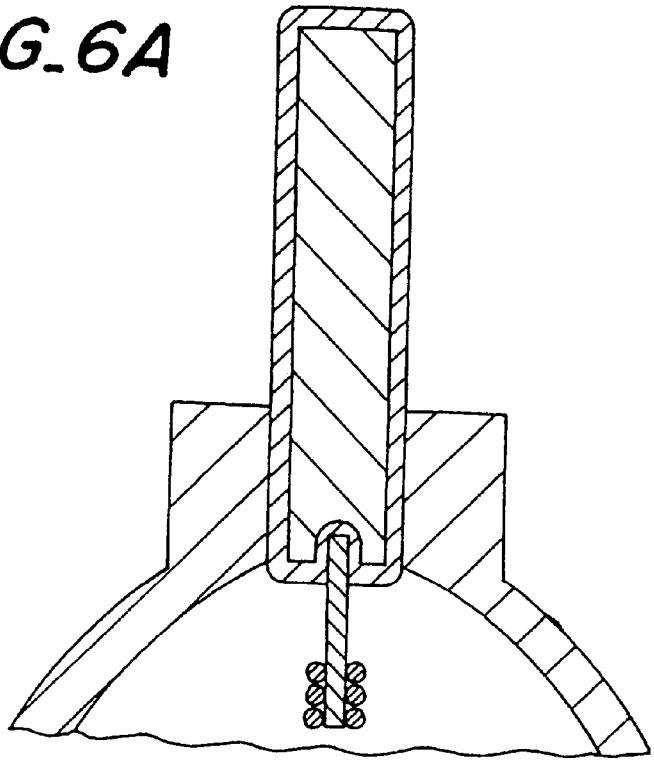
FIGS. 6A and 6B are views showing the second embodiment of the invention.
Figure 6B:
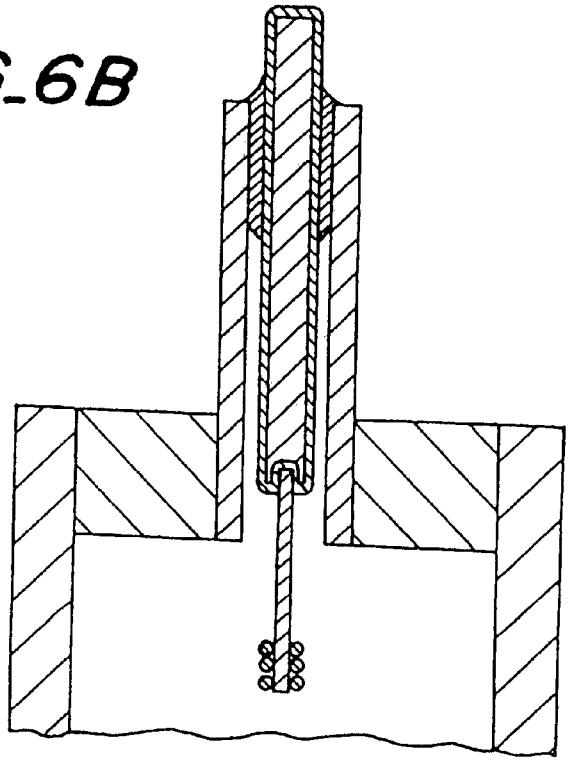

FIG. 6B is a sectional view for showing, in an enlarged scale, the surrounding area around an end portion of a ceramic discharge tube in accordance with the first embodiment of the invention and FIG. 6B is a partial enlarged view of the sectional view thereof.

As shown in FIG. 6A, a barrel-shaped vessel can be used as the vessel, and a composite electrode which has a electrode buried in a concave portion at the bottom of a current conductor can be used as the first composite electrode. Also, as shown in FIG. 6B, a composite electrode which has an electrode buried in a concave portion at the bottom of a current conductor can be used as the second composite electrode. Further, in this case, as described later, a gap between the opening of the capillary and the current conductor is tightly sealed with the molybdenum or the mixture of molybdenum and alumina.

Figure 7:
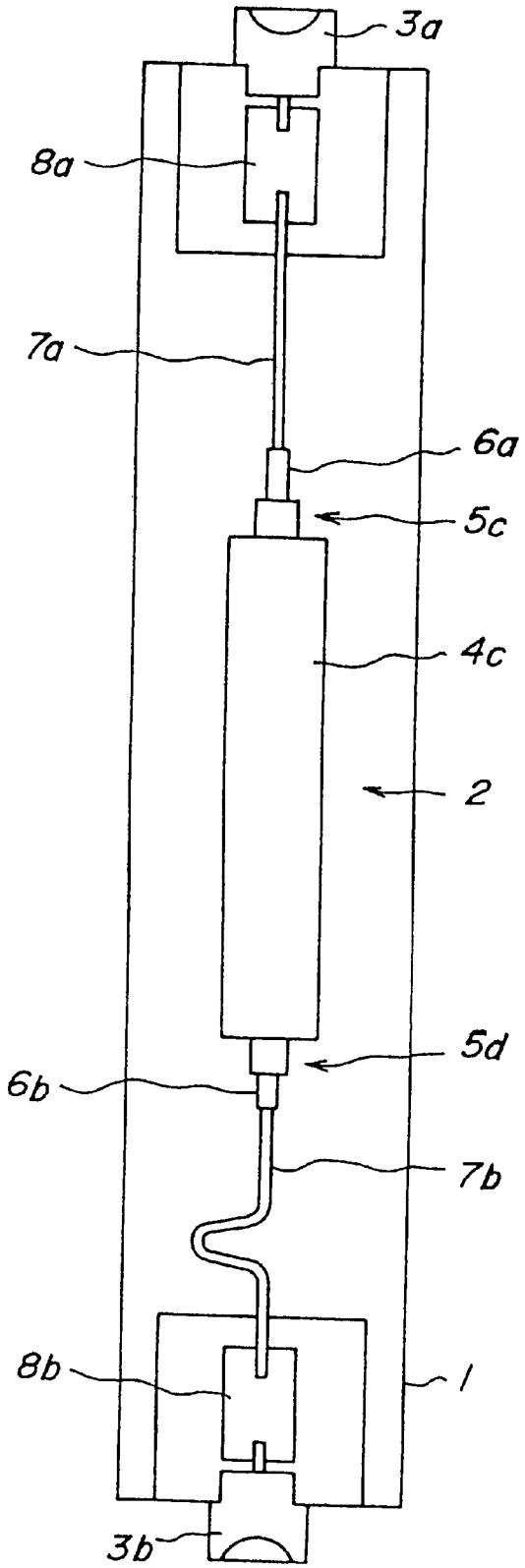
FIG. 7 is a view for describing the gas-tight sealing at one end of a ceramic discharge tube for a high pressure discharge lamp.
Figure 8:
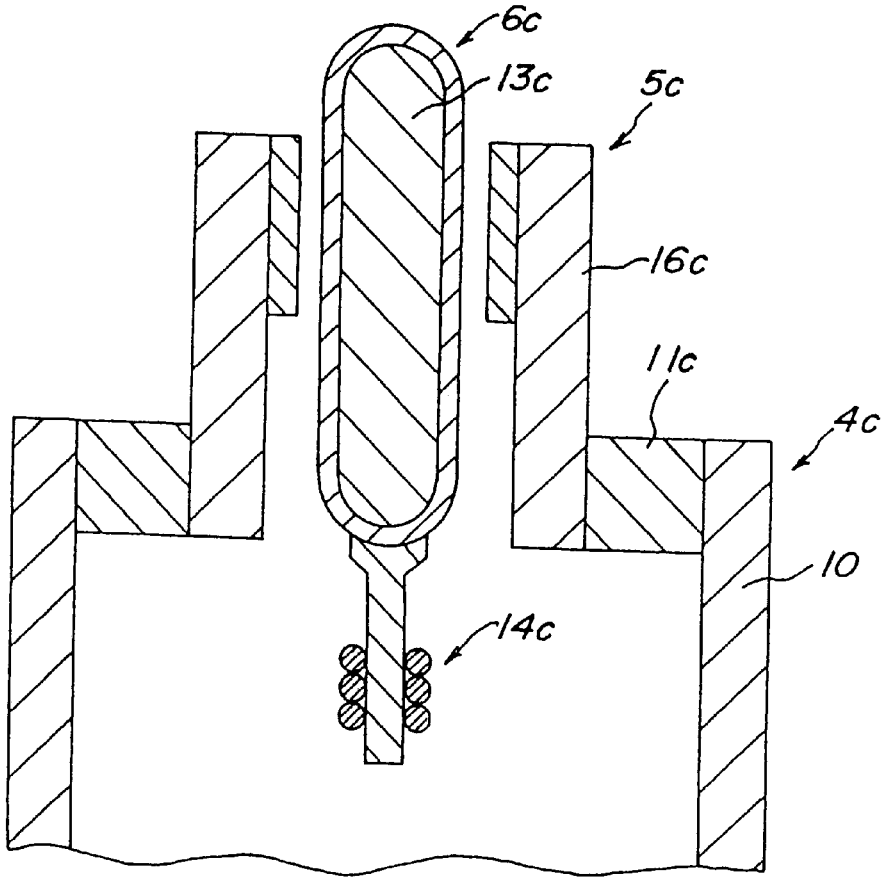
FIG. 8 is a view for describing the gas-tight sealing at one end of a ceramic discharge tube for a high pressure discharge lamp.

FIG. 7 is a view for showing a second embodiment of the high pressure discharge lamp in accordance with the invention, and FIG. 8 is a view for describing the gas-tight sealing at one end of a ceramic discharge tube for a high pressure discharge lamp. Further, in FIG. 8, as an end portion 5*c* has a construction which is the same as that of an end portion 5*d,* only the end portion 5*c* is described.

In FIG. 8, the vessel 4 has the main body 10, a plugging member made of alumina, and a capillary 16*c.* A composite electrode 6*c* has a cylindrical current conductor 13*c* with a diameter which is smaller than a diameter of the opening portion of the plugging member 11*c,* and an electrode 14*c* joined by welding at a bottom of the current conductor 13*c* exposed to inside the vessel 4. In this case, also, the electrode 14*c* has a coil 15*c*. Further, a gap between the second composite electrode 6*c* and the capillary 16*c* is tightly sealed by welding.

Also, the current conductor 13*b* of the second composite electrode 6*b* has the cylindrical member, and the metallizing layer is composed of the mixture of molybdenum and alumina.

According to the embodiment, as only the region of the opening portion of one end of the vessel is heated in a moment, an ionizable light-emitting material and a starting gas may not leak to outside of the vessel.

Figure 9A:
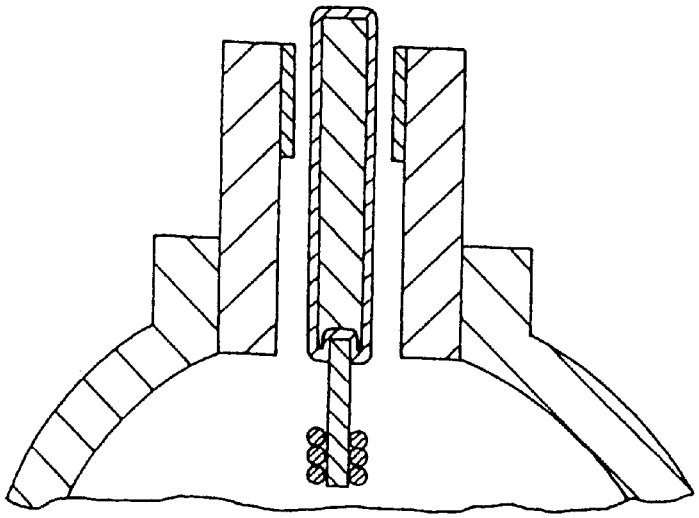
FIGS. 9A to 9G show other examples at the end of the vessel in the second embodiment.
Figure 9B:
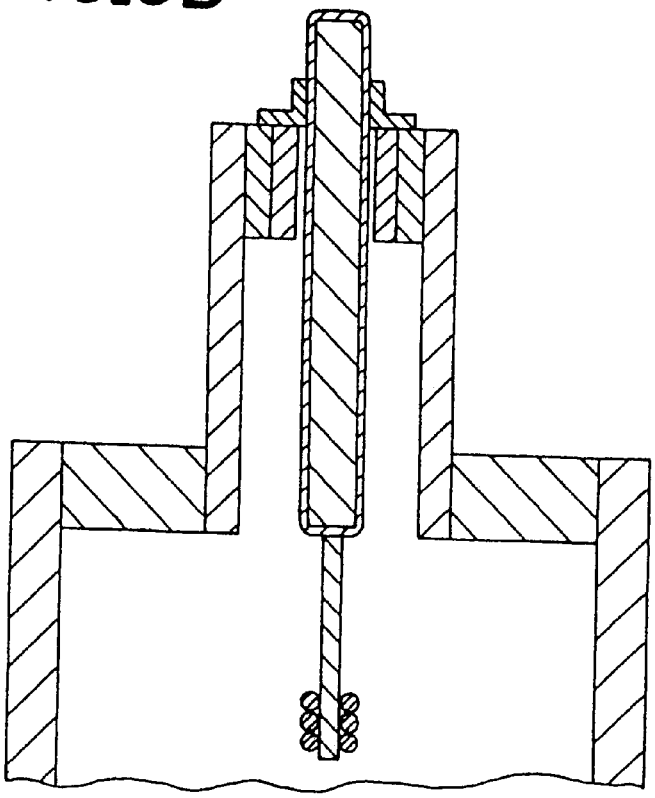
Figure 9C:
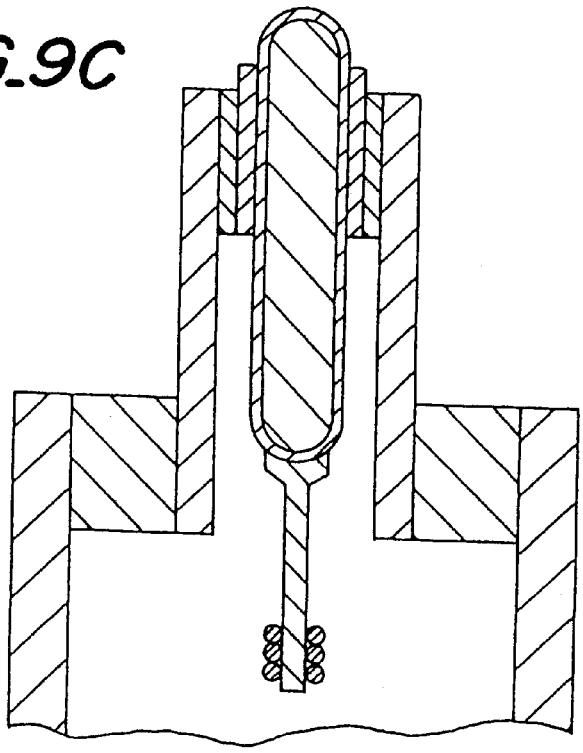
Figure 9D:
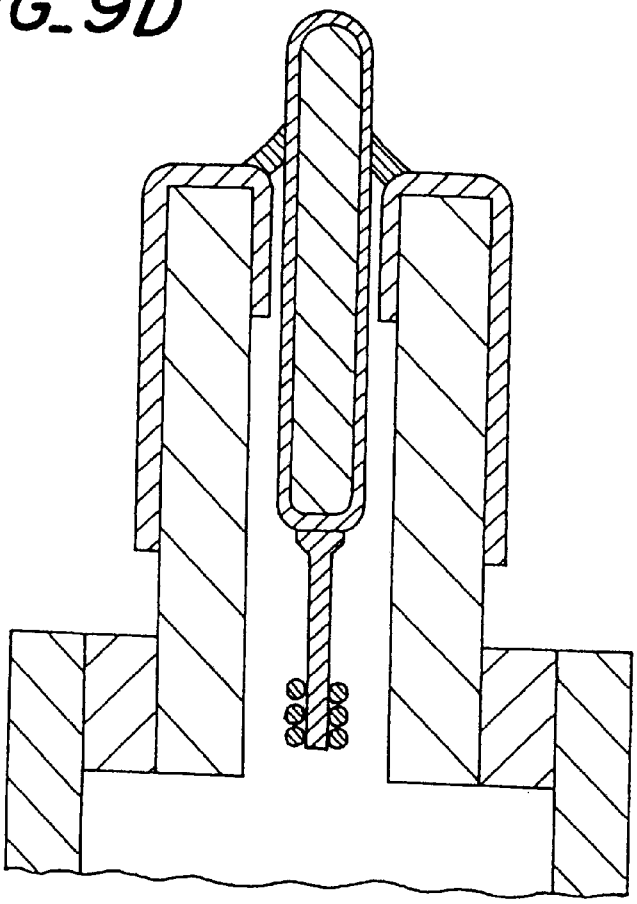
Figure 9E:
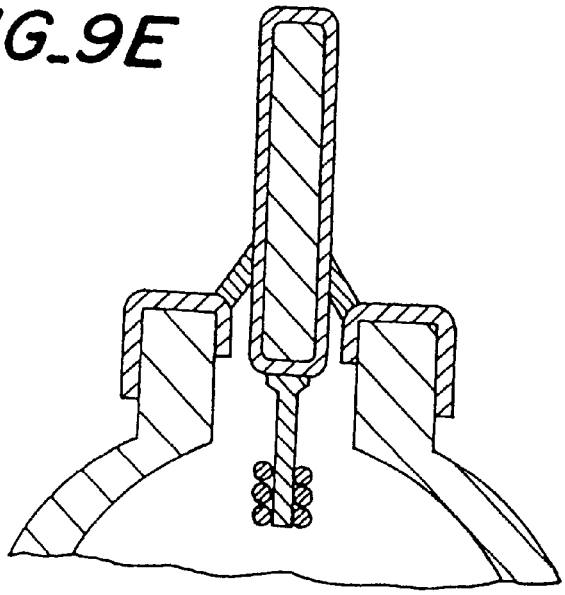
Figure 9F:
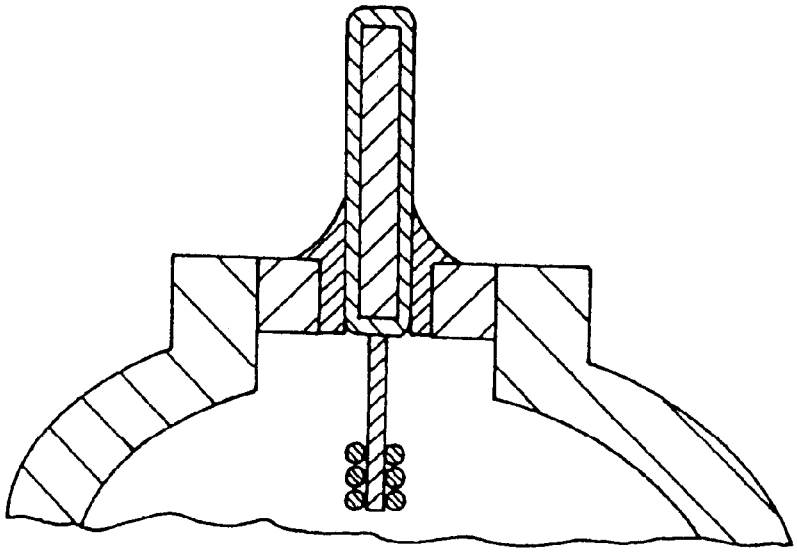
Figure 9G:
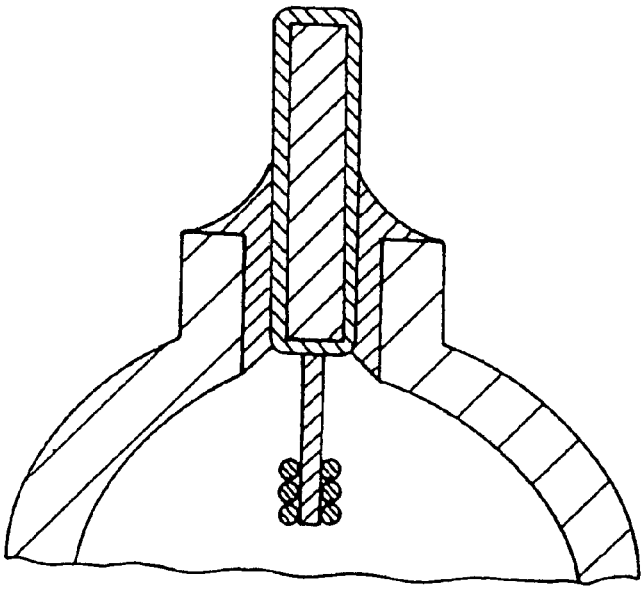

FIGS. 9A to 9G show other examples at the end of the vessel in second embodiment. In FIG. 9A, a composite electrode which has an electrode buried in a concave portion at the bottom of a current conductor is used as the composite electrode, and a gap between the composite electrode and the opening portion is tightly sealed by welding. In FIGS. 9A and 9B, the metallizing layer is formed, and the molybdenum is provided between the composite electrode and the capillary by brazing. In FIGS. 9D and 9E, a layer for melting is provided between an extending conductive layer for earth and the conductive layer. In FIGS. 9F and 9G, the capillary is not provided at the end.

FIGS. 10A to 10D are views for showing a composite electrode for a high pressure discharge lamp according to the invention.

Figure 10A:
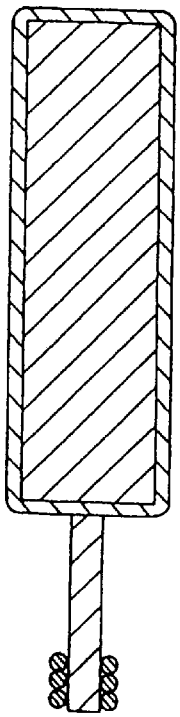
FIGS. 10A to 10D are views for showing a composite electrode for a high pressure discharge lamp according to the invention.
Figure 10B:
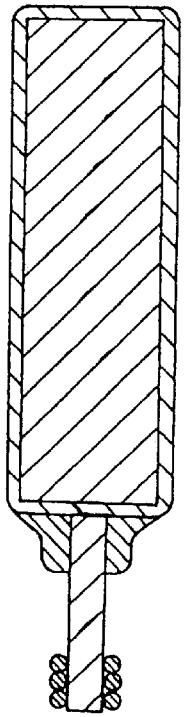
Figure 10C:
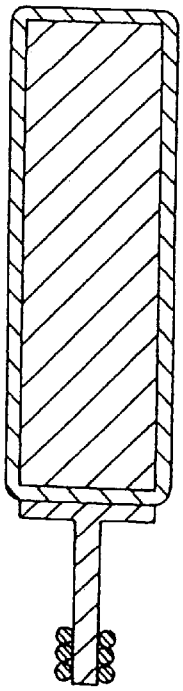
Figure 10D:
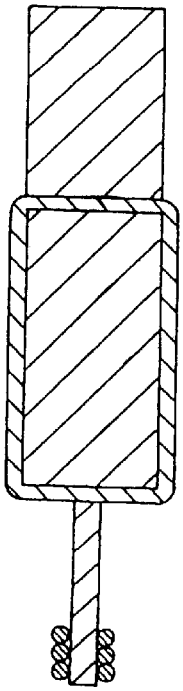

In FIG. 10A, a rod-shaped electrode is joined to the current conductor by welding. In FIG. 10B, the rod-shaped electrode is joined to the current conductor by metallizing. In FIG. 10C, an electrode having a rod-shaped portion and a disk portion is joined to the current conductor by metallizing. In FIG. 10D, a rod made of a niobium is joined to the end of the current conductor.

Next, a relation between vol. % of the molybdenum and that of the alumina, and the conductivity and gas tight property is shown in Table 1. In Table 1, for example, 20/80 denotes that the content of the molybdenum is 20 vol. %, and the content of the alumina is 80 vol. %.

TABLE 1

| volume ratio vol. % | conductivity | gas tight property |
|---|---|---|
| 20/80 | x | ◎ |
| 30/70 | Δ | ◎ |
| 40/60 | ○ | ◎ |
| 50/50 | ◎ | ◎ |
| 60/40 | ◎ | ○ |
| 70/30 | ◎ | Δ |
| 80/20 | ◎ | x |

◎. . . excellent ○. . . good Δ. . . unstable x . . . no good

According to Table 1, it is found that a preferable volume ratio is from 30/70 to 70/30.

Next, a relation between a thickness of the metallizing layer, conductivity, and the gas tight property thereof is shown in Table 2.

TABLE 2

| volume ratio vol. % | conductivity | gas tight property |
|---|---|---|
| 3 | x | ◎ |
| 5 | Δ | ◎ |
| 10 | Δ | ◎ |
| 20 | ○ | ◎ |
| 30 | ◎ | ◎ |
| 50 | ◎ | ◎ |
| 100 | ◎ | ○ |
| 200 | ◎ | Δ |
| 400 | ◎ | Δ |
| 600 | ◎ | x |

◎. . . excellent ○. . . good Δ. . . unstable x . . . no good

According to Table 2, it is found that a preferable thickness of the metallizing layer is from 20 to 400 mm.

Next, a first embodiment of a process for manufacturing the high pressure discharge lamp is described with FIGS. 2B and 4A.

First, the main body 10 is formed. A molded body formed as such is dewaxed and calcined to obtain a calcined body. Also, an alumina powder is molded to obtain a ring shaped plugging member 11*a*. Preferably, the plugging member 11*a* obtained as such is dewaxed and calcined to obtain a calcined body.

Next, the calcined body of the plugging member 11*a* is inserted into an end of the calcined body of the main body 10 to set it to a certain position, and the main body 10 and the plugging member 11*a* are calcined to obtain a calcined body of the vessel 4.

Next, the first composite electrode 6*a* formed as described later is inserted into the opening portion of the plugging member 11*a* such that the electrode 15*a* is exposed to the inner space of the vessel 4 and one end of the first composite electrode 6*a* is exposed to outside of the vessel 4, and co-firing the vessel 4 and the first composite electrode 6*a* into an integrated body. Then, the second composite electrode 6*b* is inserted into the opening portion of the plugging member 11*b* such that the electrode 15*b* is exposed to the inner space and one end of the second composite electrode 6*b* is exposed to outside, and the gap between the current conductor 13*b* and the vessel is tightly sealed with the frit seal.

Next, a second embodiment of a process for manufacturing the high pressure discharge lamp is described with FIG. 8.

First, the main body 10 is formed. A molded body formed as such is dewaxed and calcined to obtain a calcined body. Also, an alumina powder is molded to obtain a ring shaped plugging member 11*c* and the capillary 16*c*. Preferably, the plugging member 11*c* and the capillary 16*c* obtained as such are dewaxed and calcined to obtain calcined bodies.

Next, the calcined body of the plugging member 11*c* is inserted into an end of the calcined body of the main body 10 to set it to a certain position, the calcined body of the capillary 16*c* is inserted into an opening portion of the plugging member 11*c* to set it to a certain position, and the main body 10, the plugging member 11*c* and the capillary 16*c* are calcined to obtain a calcined body of the vessel 4.

Next, the composite electrode 6*c* is inserted into the opening portion of the capillary 16*c* such that the electrode 14*c* is exposed to the inner space and one end of the composite electrode 6*c* is exposed to the outside, and the gap between the current conductor 13*c* and the vessel is tightly sealed with the molybdenum layer and the layer of the mixture of molybdenum and alumina.

The process for manufacturing the composite electrode will be described with FIGS. 11A to 11C.

Figure 11A:
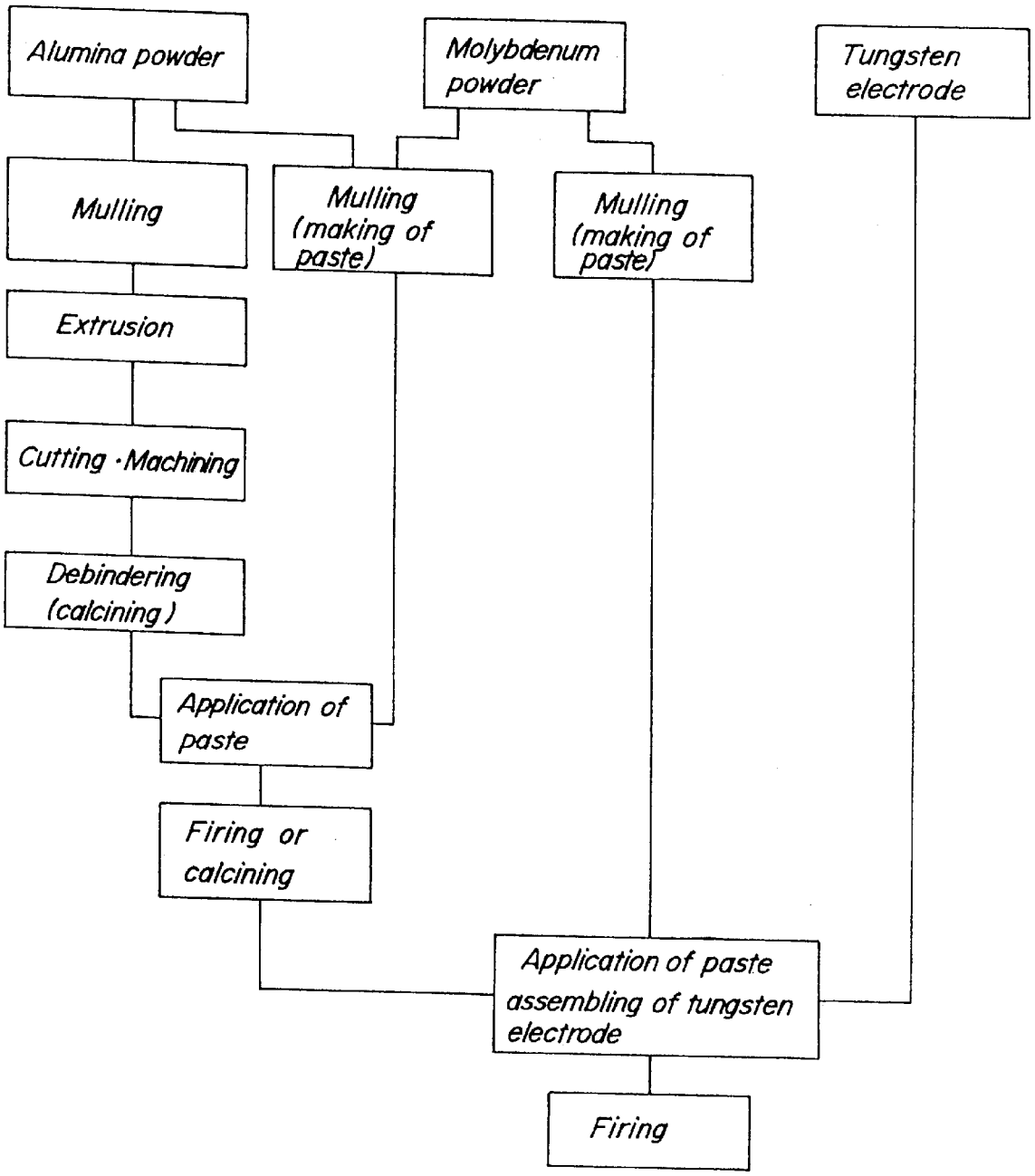
FIGS. 11A to 11C are flow charts illustrating the process for manufacturing the composite electrode.

In a flow chart in FIG. 11A, first, an alumina powder is mullited and press molded to obtain a molded body, and then, the molded body is cut and processed. In this case, the process is mainly an outer peripheral process (centerless, etc), and the cutting can be done in advance of the processing or the processing can be done in advance of the cutting. Then a binder is removed from the molded body, and the body is calcined by request.

Next, the calcined body is coated with a paste of alumina powder and molybdenum powder, and the body formed as such is fired or calcined.

Next, the calcined body is applied with a paste of molybdenum powder, the body formed as such and the electrode made of the tungsten are assembled into one body, and the body is fired.

Figure 11B:
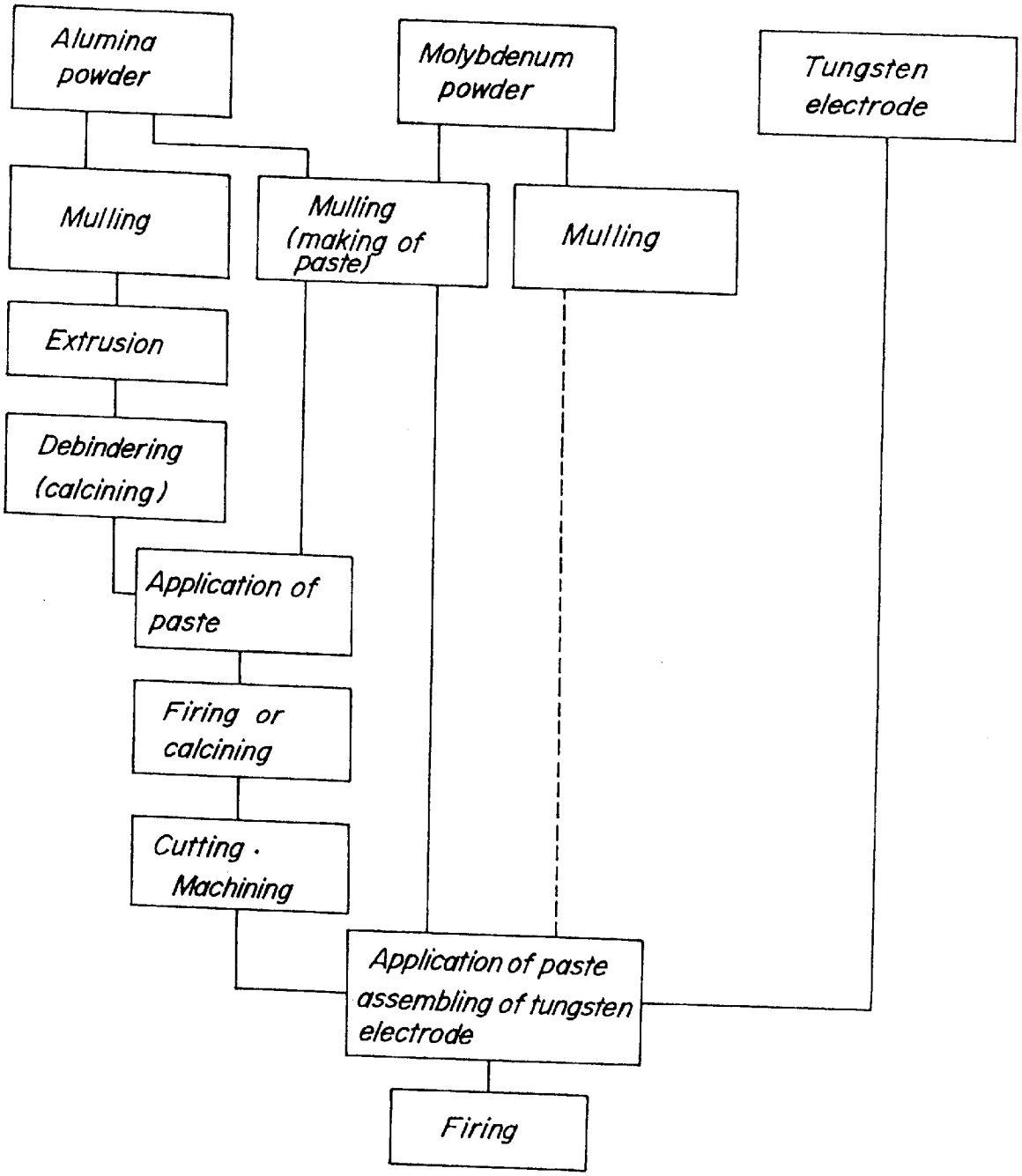

Also, the composite electrode according to the invention can be manufactured in accordance with a flow chart shown in FIG. 11B.

In this case, the cutting and processing process is done after the firing or calcining process, and the mulling of the molybdenum powder is used as required in the paste applying and assembling of the tungsten electrode process.

Figure 11C:
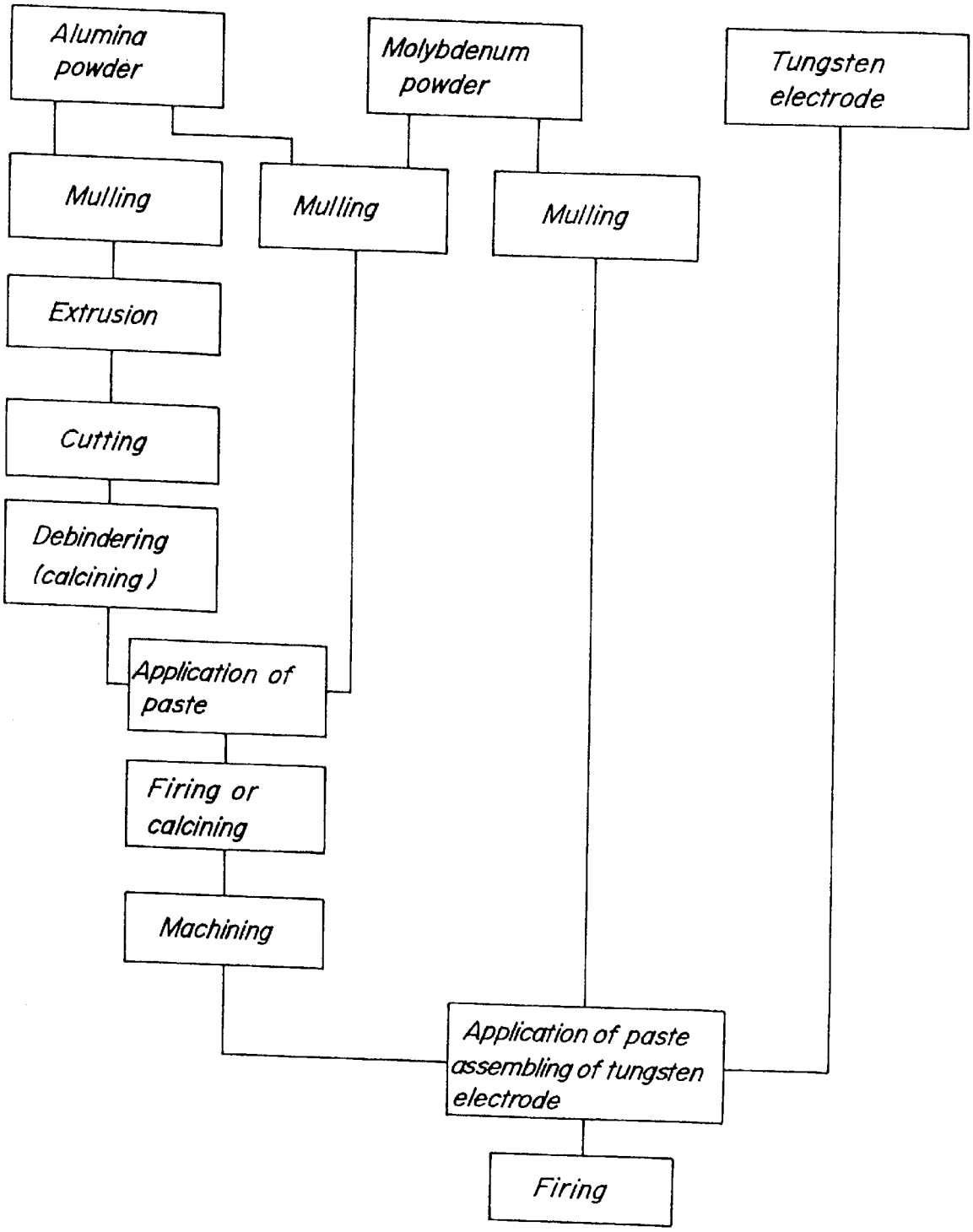

Also, the composite electrode according to the invention can be manufactured in accordance with a flow chart shown in FIG. 11C.

In this case, after the cutting process, the extrusion process follows. After the firing or calcining process, the processing process follows.

Figure 12:
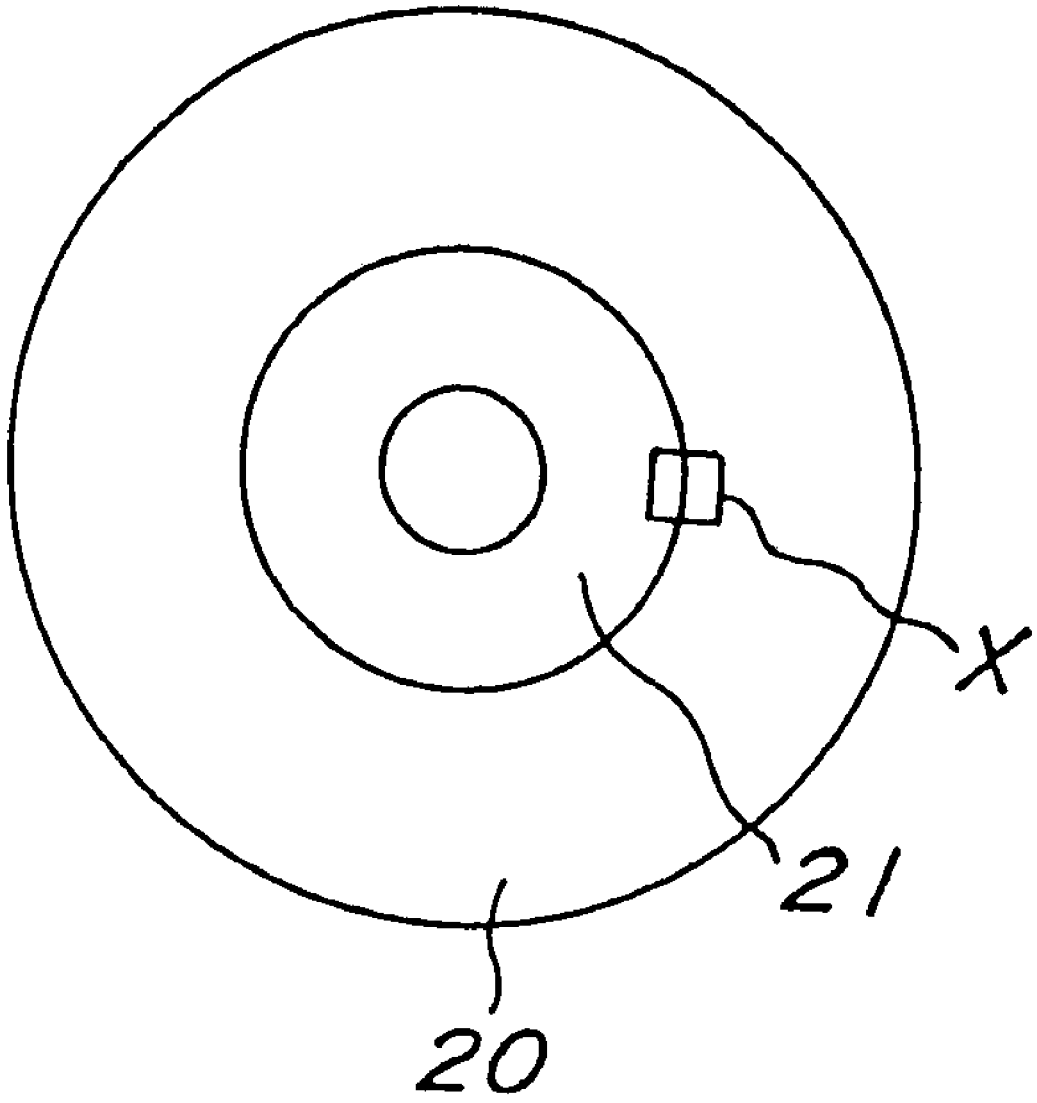
FIG. 12 is a view for describing the comparison of a prior high pressure discharge lamp and a high pressure discharge lamp according to the invention.

FIG. 12 is a view for describing a comparison of a prior high pressure discharge lamp and a high pressure discharge lamp according to the invention.

For comparing the prior high pressure discharge lamp with the high pressure discharge lamp according to the invention, a capillary 21 coated with the metallizing layer over a surface thereof is inserted into an opening portion of a tubular member 20, and the tubular member 20 and the capillary 21 are co-fired into an integrated body.

The following members are used as the capillary 21.

i) A body having a tubular member made of alumina coated by a mixture of 60 vol. % of tungsten and 40 vol. % of alumina (hereinafter, called "capillary i").

ii) A body having a tubular member made of alumina coated by a mixture of 50 vol. % of molybdenum and 50 vol. % of alumina with a thickness of 30 $\mu$m (hereinafter, called "capillary ii").

iii) A body having a tubular member made of alumina coated by a mixture of 50 vol. % of molybdenum and 50 vol. % of alumina with a thickness of 50 $\mu$m (hereinafter, called "capillary iii").

iv) A body having a tubular member made of alumina coated by a mixture of 80 vol. % of molybdenum and 20 vol. % of alumina with a thickness of 50 $\mu$m (hereinafter, called "capillary iv").

v) A body having a tubular member made of alumina coated by a mixture of 20 vol. % of molybdenum and 80 vol. % of alumina with a thickness of 30 $\mu$m (hereinafter, called "capillary v").

FIGS. 13A to 13E are photomicrographs for describing the comparison of a prior high pressure discharge lamp and a high pressure discharge lamp according to the invention. The photomicrographs show a portion X in FIG. 12A.

Figure 13A:
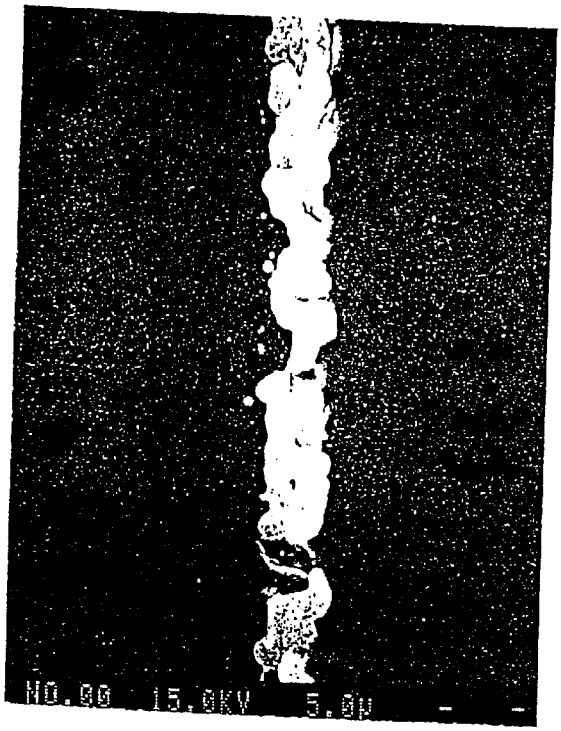
FIGS. 13A to 13E are photomicrographs for describing the comparison of a prior high pressure discharge lamp and a high pressure discharge lamp according to the invention.

FIG. 13A shows that the capillary i and the tubular member 20 are co-fired into an integrated body. Judging from this, it is found that a joining structure between the capillary i and the tubular member 20 is no good.

Figure 13B:
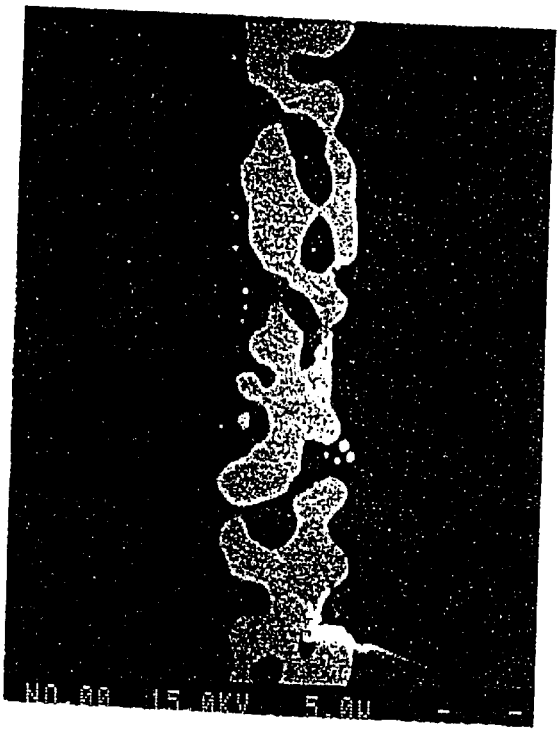

FIG. 13B shows that the capillary ii and the tubular member 20 are co-fired into an integrated body. Judging from this, it is found that a joining structure between the capillary ii and the tubular member 20 is good.

Figure 13C:
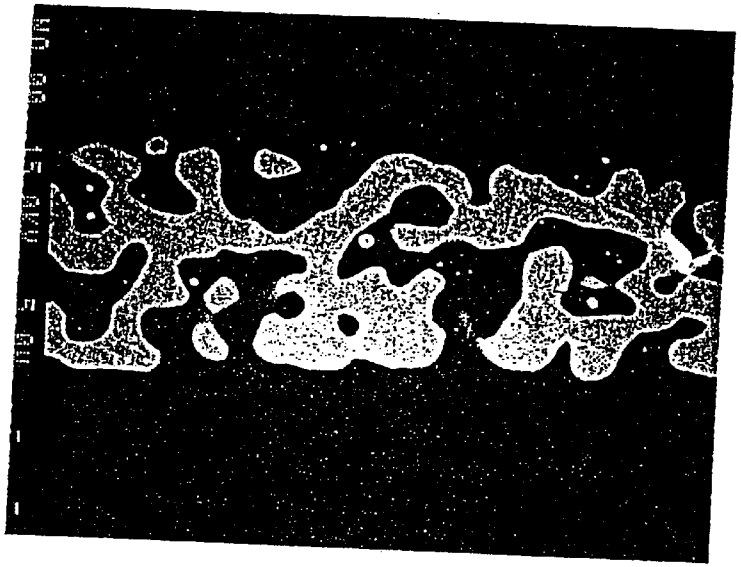

FIG. 13C shows that the capillary iii and the tubular member 20 are co-fired into an integrated body. Judging from this, it is found that a joining structure between the capillary iii and the tubular member 20 is good.

Figure 13D:
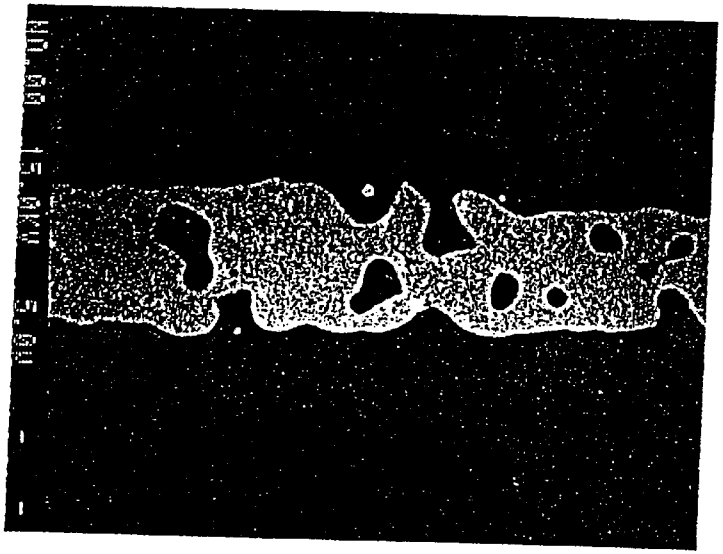

FIG. 13D shows that the capillary iv and the tubular member 20 are co-fired into an integrated body. Judging from this, it is found that a joining structure between the capillary iv and the tubular member 20 is no good.

Figure 13E:
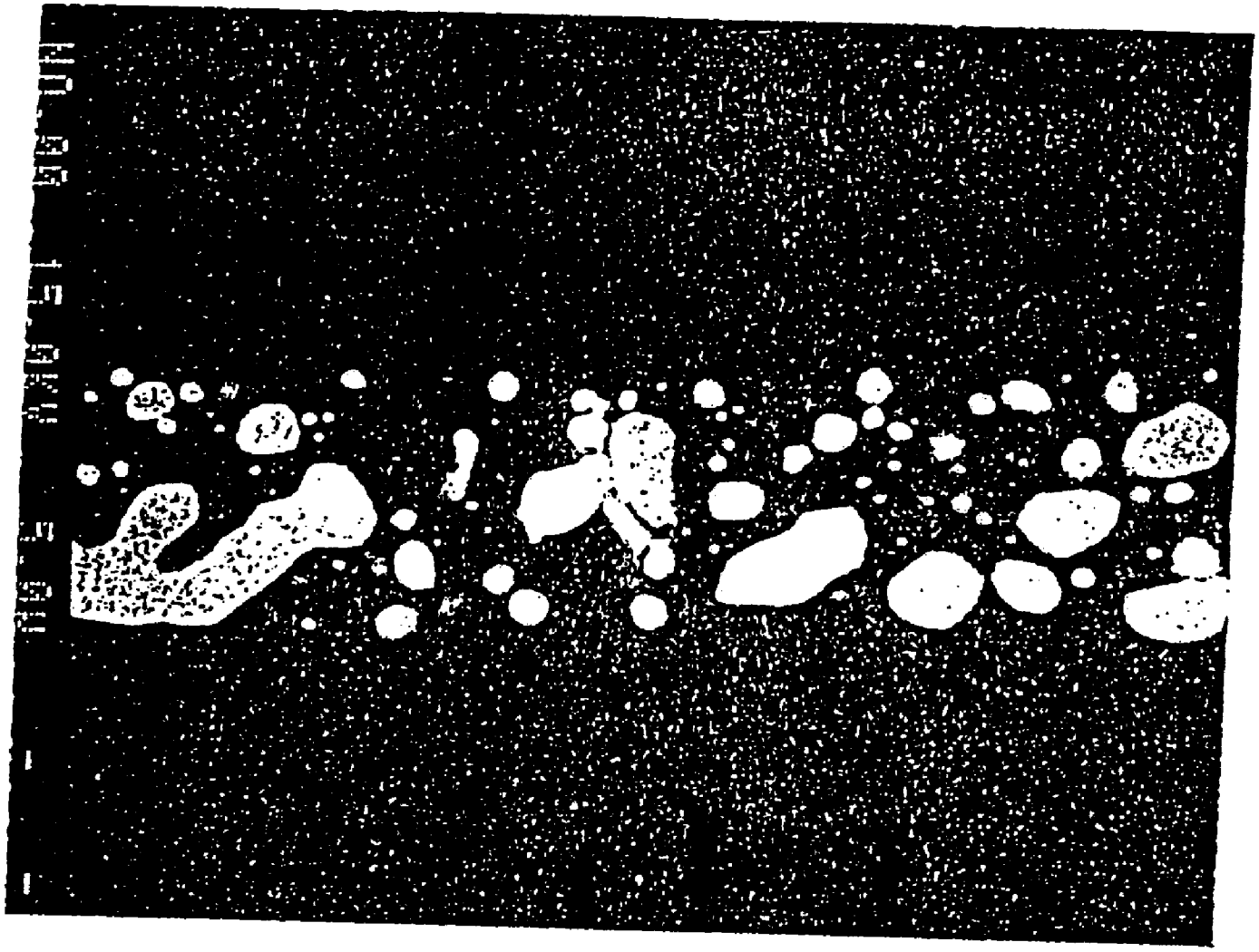

FIG. 13E shows that the capillary v and the tubular member 20 are co-fired into an integrated body. Judging from this, it is found that the metallizing layer is discontinuous.

The present invention is not limited to above embodiments, other modifications will be apparent by those skilled in the art.

For example, as the non-conductive material composing the vessel and the cylindrical member, a non-conductive material other than alumina (e.g. cermet) is used.

Also, in the above embodiments, although the metallizing layer is formed with the mixture of molybdenum and alumina, the metal of the mixture may contain not less than 50 vol. % of molybdenum and the non-conductive material of the mixture may contain not less than 50 vol. % of a material which is the same as that forming the vessel (in the above embodiment, alumina).

Also, in the first embodiment, when the gap between the second composite electrode and the vessel is tightly sealed, instead of using the frit seal, the gap may be tightly sealed with a layer made of molybdenum or a layer made of molybdenum and alumina.

Also, in the above embodiment, when the composite electrode and the vessel are co-fired into an integrated body, the main body and the plugging member are calcined with the plugging member inserted into the end of the main body, and a calcined body obtained as such is fired with the composite electrode inserted into an opening portion of the calcined body. However, the plugging member and the composite electrode are calcined with the composite electrode inserted into an opening of the plugging member, and a calcined body obtained as such and the main body are fired with the calcined body inserted into the end of the main body.

Also, for manufacturing the composite electrode, a magnesium oxide may be added to the alumina powder.

What is claimed is:

1. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is substantially same as a diameter of the opening portion at one end of the vessel, and an electrode electrically connected to the current conductor;

said current conductor of the composite electrode being formed by a substantially cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel; and said vessel and said composite electrode having been subjected to a co-firing into an integrated body, with the composite electrode inserted into the opening portion at one end of the vessel so that the electrode is exposed to the inner surface with one end of the composite electrode is exposed to outside of the vessel.

2. A high pressure discharge lamp according to claim 1, wherein the content of said metal of the mixture is 30 to 70 vol. %.

3. A high pressure discharge lamp according to claim 1, wherein said metal of the mixture contains 100 vol. % of molybdenum, and said non-conductive material of the mixture contains 100 vol. % of a material which is same as that forming said vessel.

4. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is smaller than a diameter of the opening portion at one end of the vessel, and an electrode electrically connected to the current conductor;

said current conductor of the composite electrode being formed by a substantially cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel; and said current conductor and said vessel being so arranged relative to each other as to leave a gap therebetween, with the composite electrode inserted into the opening portion at one end of the vessel so that the electrode is exposed to the inner space with one end of the composite electrode is exposed to outside the vessel, said gap being tightly sealed with a metallic layer or a layer made of a mixture of a metal and a material which is same as that forming said vessel.

5. A high pressure discharge lamp according to claim 4, wherein the content of said metal of the mixture is 30 to 70 vol. %.

6. A high pressure discharge lamp according to claim 4, wherein said metal of the mixture contains 100 vol. % of molybdenum, and said non-conductive material of the mixture contains 100 vol. % of a material which is same as that forming said vessel.

7. A high pressure discharge lamp comprising:

a vessel made of a non-conductive material which forms an inner space filled with an ionizable light-emitting material and a starting gas, and has opening portions at both ends thereof; a first composite electrode having a substantially cylindrical current conductor with a diameter which is substantially same as a diameter of the opening portion at one end of the vessel, and an electrode electrically connected to the current conductor; and a second composite electrode having a substantially cylindrical current conductor with a diameter which is smaller than a diameter of the opening portion at the other end of the vessel, and an electrode electrically connected to the current conductor;

said first and second conductors of the composite electrode being formed by a substantially cylindrical member which is made of a non-conductive material and is coated with a first mixture of a metal and a non-conductive material over substantially all of a cylindrical surface thereof, respectively;

said metal of the first mixture containing not less than 50 vol. % of molybdenum, and said non-conductive material of the first mixture containing not less than 50 vol. % of a material which is the same as that forming said vessel; and said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being tightly sealed with a metallic layer or a layer made of a second mixture of a metal and a material which is same as that forming said vessel.

8. A high pressure discharge lamp according to claim 7, wherein the content of said metal of the first mixture is 30 to 70 vol. %.

9. A high pressure discharge lamp according to claim 7, wherein said metal of the first mixture contains 100 vol. % of molybdenum, and said non-conductive material of the first mixture contains 100 vol. % of a material which is same as that forming said vessel.

10. A high pressure discharge lamp comprising:

a vessel made of a non-conductive material which forms an inner space filled with an ionizable light-emitting material and a starting gas, and has opening portions at both ends thereof; and a composite electrode having a cylindrical current conductor with a diameter which is substantially same as a diameter of the opening portion at one end of the vessel, and an electrode joined by welding or metallizing at a bottom of the current conductor exposed to inside of the vessel;

said current conductor of the composite electrode being formed by a cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel; and said vessel and said composite electrode having been subjected to a co-firing into an integrated body, with the composite electrode inserted into the opening portion at one end of the vessel so that the electrode is exposed to the inner space with one end of the composite electrode is exposed to outside of the vessel.

11. A high pressure discharge lamp according to claim 10, wherein the content of said metal of the mixture is 30 to 70 vol. %.

12. A high pressure discharge lamp according to claim 10, wherein said metal of the mixture contains 100 vol. % of molybdenum, said non-conductive material of the mixture contains 100 vol. % of a material which is same as that forming said vessel.

13. A high pressure discharge lamp comprising:

a vessel made of a non-conductive material which forms an inner space filled with an ionizable light-emitting material and a starting gas, and has opening portions at both ends thereof; and a composite electrode having a cylindrical current conductor with a diameter which is substantially same as a diameter of the opening portion at one end of the vessel, and an electrode joined by welding or metallizing at a bottom of the current conductor exposed to inside of the vessel;

said current conductor of the composite electrode being formed by a cylindrical member which is made of a non-conductive material and is coated with a first mixture of a metal and a non-conductive material over substantially all of a cylindrical surface thereof;

said metal of the first mixture containing not less than 50 vol. % of molybdenum, and said non-conductive material of the first mixture containing not less than 50 vol. % of a material which is the same as that forming said vessel; and said current conductor and said vessel being so arranged relative to each other as to leave a gap therebetween, with the composite electrode inserted into the opening portion at one end of the vessel so that the electrode is exposed to the inner space with one end of the composite electrode is exposed to outside of the vessel, said gap being tightly sealed with a metallic layer or a layer made of a second mixture of a metal and a material which is same as that forming said vessel.

14. A high pressure discharge lamp according to claim 13, wherein the content of said metal of the first mixture is 30 to 70 vol. %.

15. A high pressure discharge lamp according to claim 13, wherein said metal of the first mixture contains 100 vol. % of molybdenum, said non-conductive material of the first mixture contains 100 vol. % of a material which is same as that forming said vessel.

16. A high pressure discharge lamp comprising:

a vessel made of a non-conductive material which forms an inner space filled with an ionizable light-emitting material and a starting gas, and has opening portions at both ends thereof; a first composite electrode having a cylindrical current conductor with a diameter which is substantially same as a diameter of the opening portion at one end of the vessel, and an electrode joined by welding or metallizing at a bottom of the current conductor exposed to inside of the vessel; and a second composite electrode having a cylindrical current conductor with a diameter which is smaller than a diameter of the opening portion at the other end of the vessel, and an electrode joined by welding or metallizing at a bottom of the current conductor exposed to inside of the vessel;

said first and second current conductors of the composite electrode being formed by a cylindrical member which is made of a non-conductive material and is coated with a first mixture of a metal and a non-conductive material over substantially all of a cylindrical surface thereof, respectively;

said metal of the first mixture containing not less than 50 vol. % of molybdenum, and said non-conductive material of the first mixture containing not less than 50 vol. % of a material which is the same as that forming said vessel; and said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being tightly sealed with a metallic layer or a layer made of a second mixture of a metal and a material which is the same as that forming said vessel.

17. A high pressure discharge lamp according to claim 16, wherein the content of said metal of the first mixture is 30 to 70 vol. %.

18. A high pressure discharge lamp according to claim 16, wherein said metal of the first mixture contains 100 vol. % of molybdenum, said non-conductive material of the first mixture of a material which is same as that forming said vessel.

19. A composite electrode for a high pressure discharge lamp having a cylindrical current conductor which is made of a non-conductive material and is coated with a mixture of a metal and a non-conductive material over substantially all of a cylindrical surface thereof; and an electrode joined by welding or metallizing at a bottom of the current conductor, said metal of the mixture containing not less than 50 vol. % of molybdenum, and said non-conductive material of the mixture containing not less than 50 vol. % of a material which is the same as that forming said vessel.

20. A composite electrode for a high pressure discharge lamp according to claim 19, wherein the content of said metal of the mixture is 30 to 70 vol. %.

21. A composite electrode for a high pressure discharge lamp according to claim 19, wherein said metal of the mixture contains 100 vol. % of molybdenum, said non-conductive material of the mixture contains 100 vol. % of a material which is same as that forming said vessel.

* * * * *